United States Patent [19]

Tsuji

[11] Patent Number: 4,901,822

[45] Date of Patent: Feb. 20, 1990

[54] GROUP SUPERVISORY APPARATUS FOR ELEVATOR

[75] Inventor: Shintaro Tsuji, Inazawa, Japan

[73] Assignee: Mitsubishi Denki Kabushiki Kaisha, Japan

[21] Appl. No.: 227,602

[22] Filed: Aug. 2, 1988

[30] Foreign Application Priority Data

| | | | |
|---|---|---|---|
| Aug. 6, 1987 | [JP] | Japan | 62-197015 |
| Aug. 26, 1987 | [JP] | Japan | 62-211933 |
| Aug. 26, 1987 | [JP] | Japan | 62-211934 |

[51] Int. Cl.[4] ..... B66B 1/20

[52] U.S. Cl. ..... 187/127; 187/125

[58] Field of Search ..... 187/101, 124, 125, 127, 187/131

[56] References Cited

U.S. PATENT DOCUMENTS

| | | | |
|---|---|---|---|
| 4,499,973 | 2/1985 | De Lorenzi et al. | 187/125 |
| 4,562,530 | 12/1985 | Umeda et al. | 364/148 |
| 4,567,558 | 1/1986 | Umeda et al. | 364/148 |
| 4,669,579 | 6/1987 | Ookubu | 187/124 |
| 4,691,808 | 9/1987 | Nowak et al. | 187/125 |
| 4,719,996 | 1/1988 | Tsuji | 187/127 |
| 4,727,499 | 2/1988 | Tsuji | 187/101 |
| 4,802,557 | 2/1989 | Umeda et al. | 187/127 |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

The group supervisory apparatus for an elevator according to one aspect of the present invention for assigning a plurality of cages to a hall of congestion when the congestion of the hall is detected comprises reference service interval setting means for setting a reference value of a period (hereinbelow termed "a reference service interval") from when the cage to be previously serviced becomes a first state states of a cage are termed arbitrarily upon operations, such as the decisions of the stop of the cage, the opening/closing operation of the door, the open state of the door, the start, or the stop) to when the cage to be serviced later becomes a second state of one of the above-described states in response to the traffic volume of the hall of congestion. This aspect of the present invention further comprises reference time setting means for setting a reference value of a time (hereinbelow termed "a reference time") when the other cage becomes the second state in the hall of congestion on the basis of the first state time of the predetermined cage and the reference service interval in response to the number of the cages of additional assignment, second state time predicting means for predicting a time when the cage becomes the second state in the hall of congestion, and additional assigning means for selecting and assigning the cage having a small deviation between the second state predicting time and the reference time as the cage of additional assignment.

15 Claims, 20 Drawing Sheets

REF TIME
SET PROM
(37)

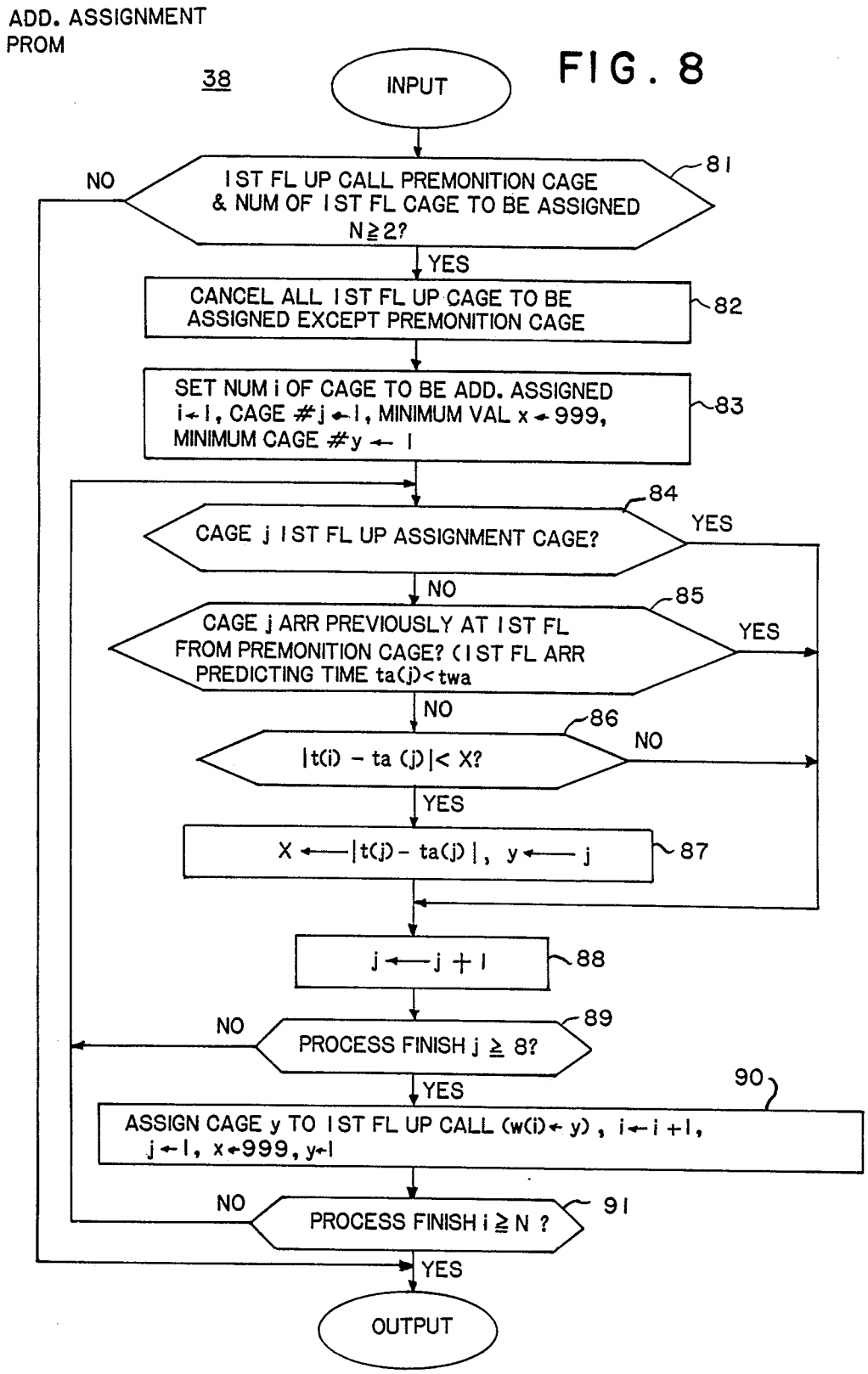
ADD. ASSIGNMENT PROM
38
INPUT
FIG. 8
1ST FL UP CALL PREMONITION CAGE & NUM OF 1ST FL CAGE TO BE ASSIGNED N≧2?
81
NO
YES
CANCEL ALL 1ST FL UP CAGE TO BE ASSIGNED EXCEPT PREMONITION CAGE
82
SET NUM i OF CAGE TO BE ADD. ASSIGNED i←1, CAGE #j←1, MINIMUM VAL x←999, MINIMUM CAGE #y←1
83
CAGE j 1ST FL UP ASSIGNMENT CAGE?
84
YES
NO
CAGE j ARR PREVIOUSLY AT 1ST FL FROM PREMONITION CAGE? (1ST FL ARR PREDICTING TIME ta(j)<twa
85
YES
NO
|t(i) − ta (j)|< X?
86
NO
YES
X ←|t(j) − ta(j)|, y ← j
87
j ← j + 1
88
PROCESS FINISH j ≧ 8?
89
NO
YES
ASSIGN CAGE y TO 1ST FL UP CALL (w(i)← y), i←i+1, j←1, x←999, y←1
90
PROCESS FINISH i ≧ N ?
91
NO
YES
OUTPUT

GROUP SUPERVISORY APPARATUS FOR ELEVATOR

BACKGROUND OF THE INVENTION

The present invention relates to a group supervisory apparatus for an elevator for selecting and assigning an elevator car (hereinbelow termed "cage" or a plurality of elevator cages) to respond to a hall call.

A plurality of elevators are installed, under group supervisory operation including an assignment system. This system calculates assignment evaluation values for the respective cages immediately after a hall call is registered, selects and assigns the cage with the best evaluation value as the cage to respond to improve operation efficiency and to shorten the hall waiting time. In such a group supervisory elevator assignment system, arrival indicator lamps are generally mounted for the respective cages in the halls of the respective floors to indicate the direction and imminent arrival of the assigned cage for waiting passengers in the hall. Therefore, the waiting passengers can wait in front of the indicated cage entrance without anxiety.

In a congested hall where a number of passengers are waiting, like an entrance floor at the end of the day, i.e., the office-going time, the office-going time is utilized, for example, on the basis of the time and the passenger volume, to assign two or more cages for the entrance floor, or the number of waiting passengers in the hall is detected to assign two or more cages under the condition that the number of waiting passengers exceeds a predetermined value as disclosed in Japanese Patent Laid-open Application No. 58739/1975, thereby eliminating the congestion in the hall.

Heretofore, when two or more cages are assigned for one hall call in this manner, the method of assigning the cages is in the order of the cage with the best assignment evaluation value. In general, when the cage of the best assignment evaluation value is selected for the floor of congestion, such as an entrance floor, there is high possibility that the cage with the shortest time to arrive at the floor of congestion is selected, and the probability that a plurality of cages will arrive at the floor of congestion is increased. Accordingly, at this time, the transportation efficiency is very deteriorated or waiting time is lengthened due to the fact that the cages are sequentially dispatched at a short time interval. In this state, the passengers are boarded into two or more cages and the cages still have sufficient margin of volume, or after the cages depart in a short time interval, a considerable time is taken until the next cage arrives so that the next passengers wait for a long time.

Therefore, there has been proposed a system that, when the congestion of the first floor is, for example, detected, a reference value of the period from when the cage to be serviced previously on the first floor arrives, i.e., reaches an arrival state to when a cage to be similarly serviced later becomes an arrival state (hereinafter referred to as "a reference service interval") is set on response to the traffic volume in the first floor. A reference value of times when a predetermined cage becomes an arrival state and when the other cage becomes an arrival state in on the first floor on the basis of the reference service interval (hereinafter referred to as "a reference time") is set corresponding to the additional number of assigned cages, and the cage having a small deviation between the predicted time and the reference time is selected as the cage of the additional assignment.

This cage becomes an arrival state on the first floor to reduce the service of the cages arrived concentratively in the hall of congestion, thereby improving the transportation efficiency.

Further, there have been proposed several assignment methods for the purpose of shortening waiting time by preventing the operation of a plurality of cages in a group simultaneously. For example, there is one system disclosed in Japanese Patent Laid-open Application No. 121186/1987. This system has features for the purpose of eliminating the operation of a plurality of cages concentratively. This system calculates a predetermined evaluation concerning the waiting time of each cage for the hall call generated to select the cage of the optimal evaluation value obtained thereby to respond to the call. When the optimal cage is selected, the generated hall call is temporarily assigned to the respective cages to obtain an index indicating a deviation between the arrival interval at a specific floor at the time of this temporary assignment and an average operation interval for each cage. This index is added to the evaluation value of the corresponding cage as a general evaluation value, and the cage of this general evaluation value exhibiting a preferable value is preferentially assigned to the hall call. At this time, an average arrival interval of the cage from one cycle time in this time zone is obtained, and the assignment control of the cage to the hall call is so carried out as to disperse the predicted arrival time of each cage to the specific floor at the uniform time interval responsive to the average operation interval in the present time zone.

However, since this assigning method uses the average arrival interval obtained from one cycle time but does not use the average arrival interval set in response to the traffic volume of the floor of congestion, it has an effect of dispersing the cages to be able to respond to the hall calls of all the floors in a short time, but it is scarcely said to have an effect of improving the transporting efficiency of the floor of congestion compound to a system for servicing the hall calls of the floors of congestion by assigning a plurality of cages to the hall calls as described above.

Further, in the above-described assignment control, the reference time for arrival of the cages at the floor of congestion or the specific floor is set by using the average arrival interval obtained from the reference service interval set in response to the traffic volume of the floor of congestion or one cycle time. The cage having a small deviation between the arrival predicted time and the reference time is merely selected, but no procedure is determined for the operation of the assigned cage after the assignment. Thus, the assigned cages might not arrive at the floor of congestion or a specific floor within the reference time, and there arises a drawback that the improvement in the transporting efficiency of the floor of congestion and the reduction of the waiting time due to the prevention of the operation of a plurality of cages concentratively cannot be always performed.

SUMMARY OF THE INVENTION

The present invention has been made in order to solve the above drawbacks of the prior art, and has for its object to provide a group supervisory apparatus for an elevator which can eliminate the concentrated service of a plurality of assigned cages when a plurality of cages are assigned to the floor of congestion to improve the transporting efficiency of the floor of congestion and to shorten the waiting time of passengers.

It is another object of the present invention to provide a group supervisory apparatus for an elevator to solve the above drawbacks and which allows the assigned cage to arrive at the floor of congestion or a specific floor using a reference time to improve the transporting efficiency of the floor of congestion and to shorten the waiting time of the hall call.

The group supervisory apparatus for an elevator according to one aspect of the present invention for assigning a plurality of cages to a hall of congestion when the congestion of the hall is detected comprises reference service interval setting means for setting a reference value of a period (hereinbelow termed "a reference service interval") from when the cage to be previously serviced becomes a first state (states of a cage are termed arbitrarily upon operations, such as the decisions of the stop of the cage, the opening/closing operation of the door, the open state of the door, the start, or the stop) to when the cage to be serviced later becomes a second state of one of the above-described states in response to the traffic volume of the hall of congestion. This aspect of the apparatus also comprises reference time setting means for setting a reference value of a time (hereinbelow termed "a reference time") when the other cage becomes the second state in the hall of congestion on the basis of the first state time of the predetermined cage and the reference service interval in response to the number of the cages of additional assignment, second state time predicting means for predicting a time when the cage becomes the second state in the hall of congestion, and additional assigning means for selecting and assigning the cage having a small deviation between the second state predicting time of the hall of congestion and the reference time of the cage of additional assignment.

In the present invention, when the congestion of the hall is detected, a reference service interval is set in response to the traffic volume of the hall of congestion, the reference time to the hall of congestion is set in response to the number of the cage of additional assignment on the basis of the reference service interval and the first state time of the predetermined cage, and the cage having the small deviation between the second state predicting time and the reference time is assigned as the cage of the additional assignment.

The group supervisory apparatus for an elevator according to another aspect of the present invention for selecting and assigning a cage to be serviced from a plurality of cages to respond to the hall call comprises reference time setting means for setting a reference time when the assigned cage becomes a predetermined state in a specific hall, predicting means for predicting a time when the cage becomes the predetermined state in the specific hall, assigning means for selecting and assigning the cage to be assigned on the basis of the deviation between the predicting time and the reference time according to the predicting means, discriminating means for comparing the predicting time of the assigned cage and the reference time to output an arrival delay command to the cage to be assigned by detecting the fact that the predicting time is earlier than the reference time, and delaying means for switching to a delaying operation to increase the stopping time or running time of the assigned cage in the midway floor to the destination of the specific floor in response to the arrival delay command.

In the present invention, by detecting the fact that the predicting time in which the assigned cage becomes a predetermined state in the specific hall is earlier than the reference time, the delaying operation is carried out by the assigned cage for increasing the stopping time or the running time in the midway floor to the specific floor.

Further, the group supervisory apparatus for an elevator according to still another aspect of the present invention for selecting and assigning a cage to be serviced from a plurality of cages to respond to the hall call comprises reference time setting means for setting a reference time when the assigned cage becomes a predetermined state in a specific hall, predicting means for predicting a time when the cage becomes the predetermined state in the specific hall, assigning means for selecting and assigning the cage to be assigned on the basis of the deviation between the predicting time and the reference time according to the predicting means, discriminating means for comparing the predicting time of the assigned cage and the reference time to output an arrival delay command to the cage to be assigned by detecting the fact that the predicting time is later than the reference time, and advancing means for switching to an advancing operation to decrease the stopping time or running time of the assigned cage in the midway floor to the destination of the specific floor in response to the arrival delay command.

In the present invention, by detecting the fact that the predicting time in which the assigned cage becomes a predetermined state in the specific hall is later than the reference time, the advancing operation is carried out by the assigned cage for decreasing the stopping time or the running time in the midway floor to the specific floor.

BRIEF DESCRIPTION OF THE DRAWINGS

FIG. 8 is a flow chart showing an additional cage assigning program;

FIGS. 15, 16(*a*) and 16(*b*) are views showing a fifth embodiment of a group supervisory apparatus for an elevator according to the present invention, wherein FIG. 15 is a relay circuit diagram of door control means and delaying means, and FIGS. 16(*a*) and 16(*b*) are diagrams of door opening/closing time waveforms;

FIGS. 21, 22(*a*) and 22(*b*) are views showing a seventh embodiment of a group supervisory apparatus for an elevator according to the invention, wherein FIG. 21 is a relay circuit diagram of door control means and advancing means, and FIGS. 22(*a*) and FIG. 22(*b*) are diagrams of door opening/closing time waveforms.

In the drawings, the same symbols indicate identical or corresponding portions.

PREFERRED EMBODIMENTS OF THE INVENTION

Now, embodiments of the present invention will be described with reference to the drawings.

FIGS. 1 to 8 show a first embodiment of a group supervisory apparatus for an elevator according to the present invention.

Figure 1:
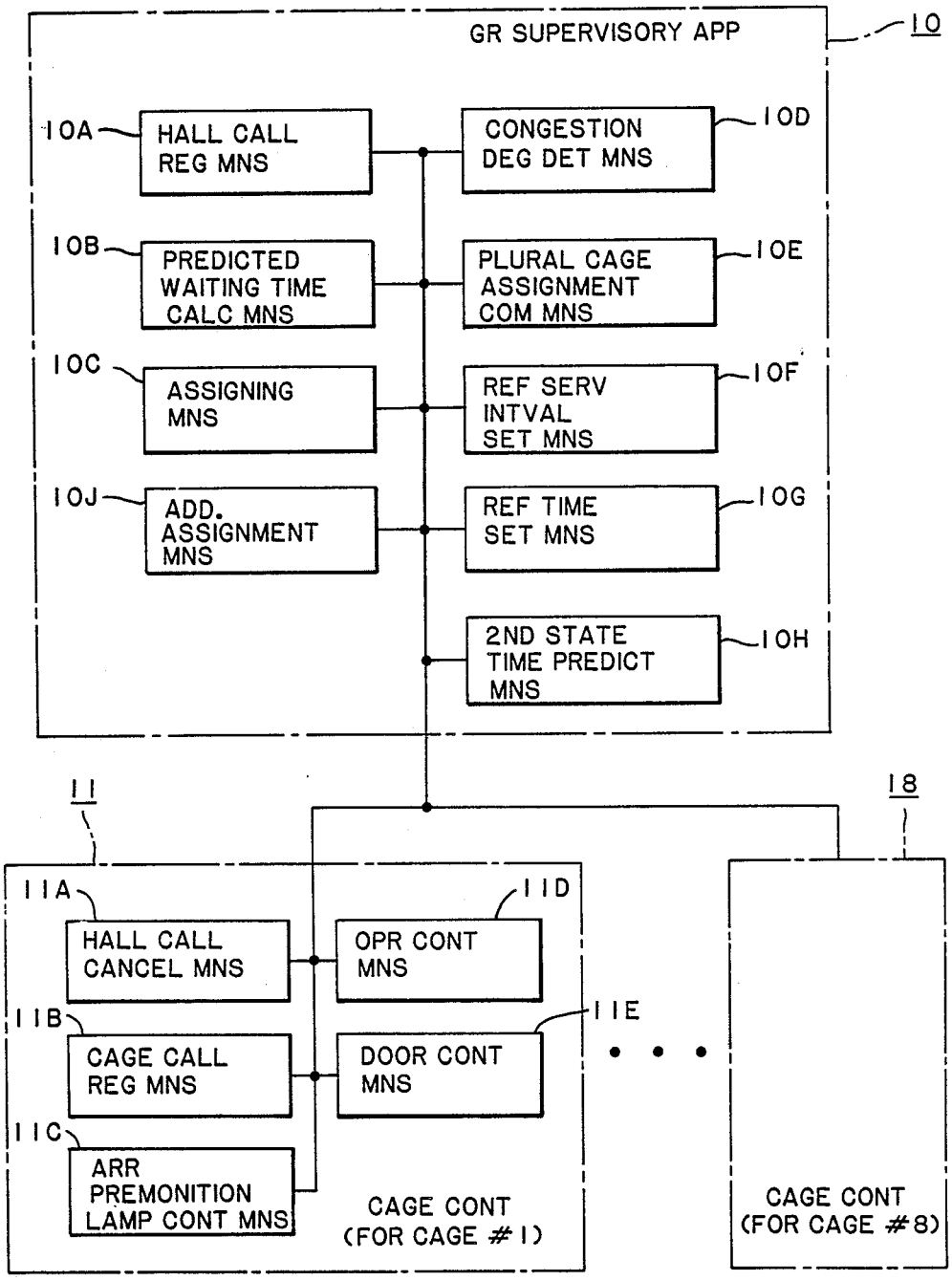
FIG. 1 is a view of an entire arrangement of a first embodiment of a group supervisory apparatus for an elevator according to the present invention.

FIG. 1 shows an entire arrangement illustrating in a block diagram various functions of a group supervisory apparatus 10 and functions of cage controllers 11 to 18 for cage No. 1 to cage No. 8 controlled by the group supervisory apparatus 10. Symbol 10A denotes hall call registration means for registering and cancelling the hall call (up-call and down-call) in the floors and calculating a lapse time (hereinbelow termed "a continuation time"), symbol 10B denotes predicted waiting time calculating means for calculating the predicted value of the time required until each cage arrives at the hall of each floor (hereinbelow termed "an arrival predicting time") and adding the arrival predicting time of the assigned cage and the continuation time to calculate the predicting waiting time of the hall call, symbol 10C denotes assigning means for selecting and assigning one best cage for serving the hall call, symbol 10D denotes known congestion degree detecting means for detecting the congestion degree of a first floor, for detecting the number of waiting passengers, for example, by the video projected by an industrial television camera (ITV) provided on the ceiling of the first floor elevator hall. Symbol 10E denotes plural cages assignment commanding means for commanding to assign a plurality of cages when the output of the congestion degree detecting means 10D exceeds a specified value and the congestion of the first floor is detected, and symbol 10F denotes reference service interval setting means for setting the reference value of a service interval for the first floor in response to the traffic volumes on the first floor and the other floors.

Figure 2:
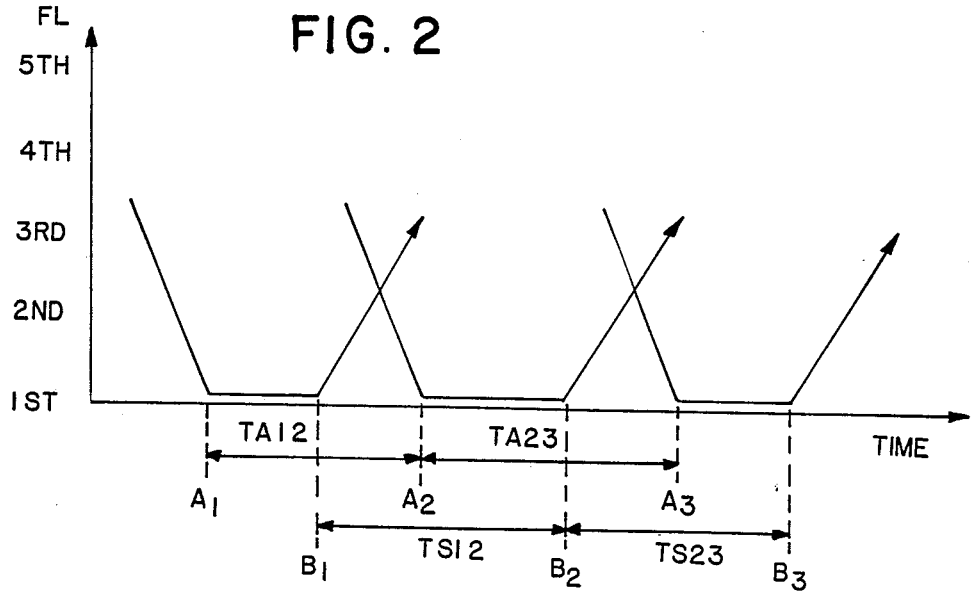
FIG. 2 is an operation diagram for explaining the service interval of the first embodiment of the invention.

Here, the service interval on the first floor means a period of term from when the cage for previously serving the first floor becomes a first state, e.g., an arrival state (the time of which is hereinbelow termed "first state time") to when the cage for lately serving similarly becomes a second state, e.g., an arrival state (the time of which is hereinbelow termed "second state time"). This will be described with reference to the operation diagram of the cage shown in FIG. 2. In FIG. 2, symbols $A_1$, $A_2$ and $A_3$ denote the arrival times of the cage Nos. 1 to 3 to the first floor, and symbols $B_1$, $B_2$ and $B_3$ denote similarly the departure times of the cage Nos. 1 to 3 to the first floor. In this case, a term $TA_{12}$ representing the period between the time point $A_1$ and the time point $A_2$ and a term $TA_{23}$ representing the period between the point $A_2$ and the point $A_3$ are service intervals in terms of the cage arrival times. On the other hand, a term $TB_{12}$ representing the period between the point $B_1$ and the point $B_2$ and a term $TB_{23}$ representing the period between the point $B_2$ and the point $B_3$ are service intervals in terms of the cage departure times. In addition, the period between the point $B_1$ and the point $A_2$ and that in terms of the door opening time point can be variably considered, but, in this embodiment, the service interval in terms of the arrival time point will be employed for the convenience of description.

Referring back to FIG. 1, symbol 10G denotes reference time setting means for setting a reference value (reference time) of the time that other cage becomes an arrival state (second state) on the basis of a predetermined cage arrival time (first state time) and the reference service interval in response to the number of cages of additional assignment, symbol 10H denotes second state time predicting means for calculating a first floor arrival predicting time of each cage as a second state predicting time, and symbol 10J denotes additional assignment means for selecting and assigning a cage having a smallest deviation between the arrival predicting time (second state predicting time) to the first floor and the reference time as a cage of additional assignment when receiving a command from the plural cages assignment commanding means 10E. It is noted that the times are always set at a present time as a starting time with respect to the time in the group supervision.

Symbol 11A denotes hall call cancelling means provided in the cage controller 11 for the cage No. 1 for outputting a hall call cancel signal to the hall calls on the respective floors, symbol 11B denotes cage call registration means for registering similarly the cage calls on the respective floors, symbol 11C denotes arrival premonition lamp control means for controlling similarly the lighting of the arrival premonition lamps (not shown) on the respective floors, symbol 11D denotes operation control means for controlling the basic operations, such as running, stopping or serving direction of the cage so as to respond to the cage call or the assigned hall call, symbol 11E denotes door control means for controlling the opening/closing of an elevator cage door, and the hall call cancelling means 11A, the cage call registration means 11B, the arrival premonition lamp control means 11C and the operation control means 11D are all known. The cage controllers 12 to 18 for the cage Nos. 2 to 8 are constructed similarly to the cage controller 11 for the cage No. 1.

Figure 3:
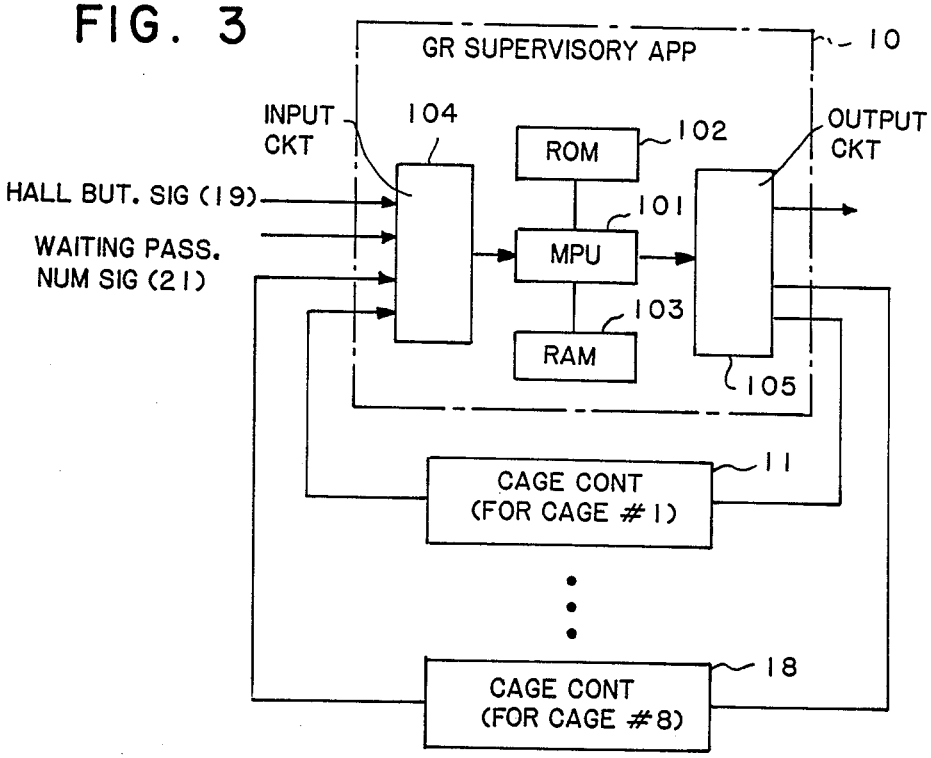
FIG. 3 is a block diagram of a group supervisory apparatus 10.

FIG. 3 is a block circuit diagram of the group supervisory apparatus 10. The group supervisory apparatus 10 has a microcomputer (hereinbelow referred to as "a MCOM"), which includes an MPU (microprocessing unit) 101, an ROM 102, an RAM 103, an input circuit 104, and an output circuit 105. The input circuit 104 inputs hall button signals 19 from hall buttons on the respective floors, state signals from the cage Nos. 1 to 8 from the cage controllers 11 to 18, and waiting passenger number signals 21 from a congestion degree detector provided on the first floor, and the output circuit 105 outputs a signal 20 to the hall button lamps contained in the respective hall buttons, and command signal to the cage controllers 11 to 18.

Figure 4:
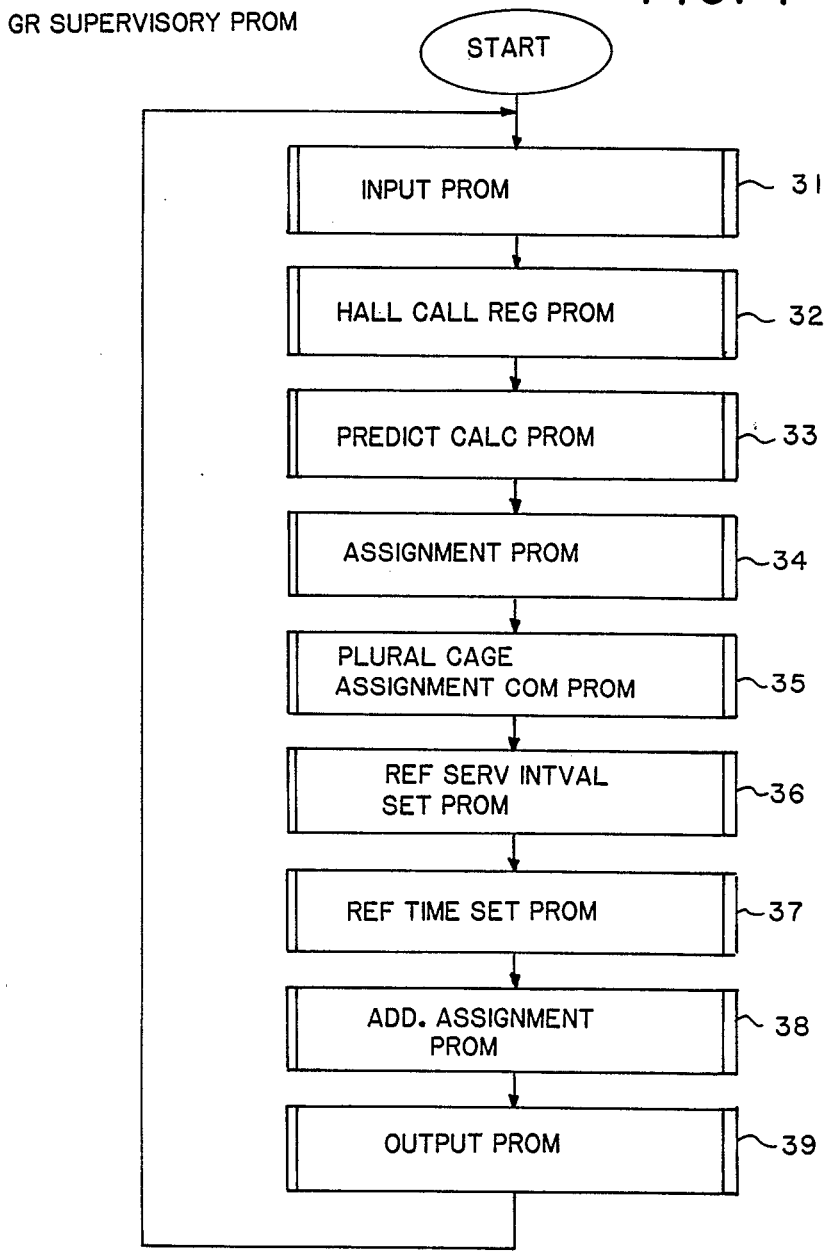
FIG. 4 is a flow chart showing a group supervisory program.
Figure 5:
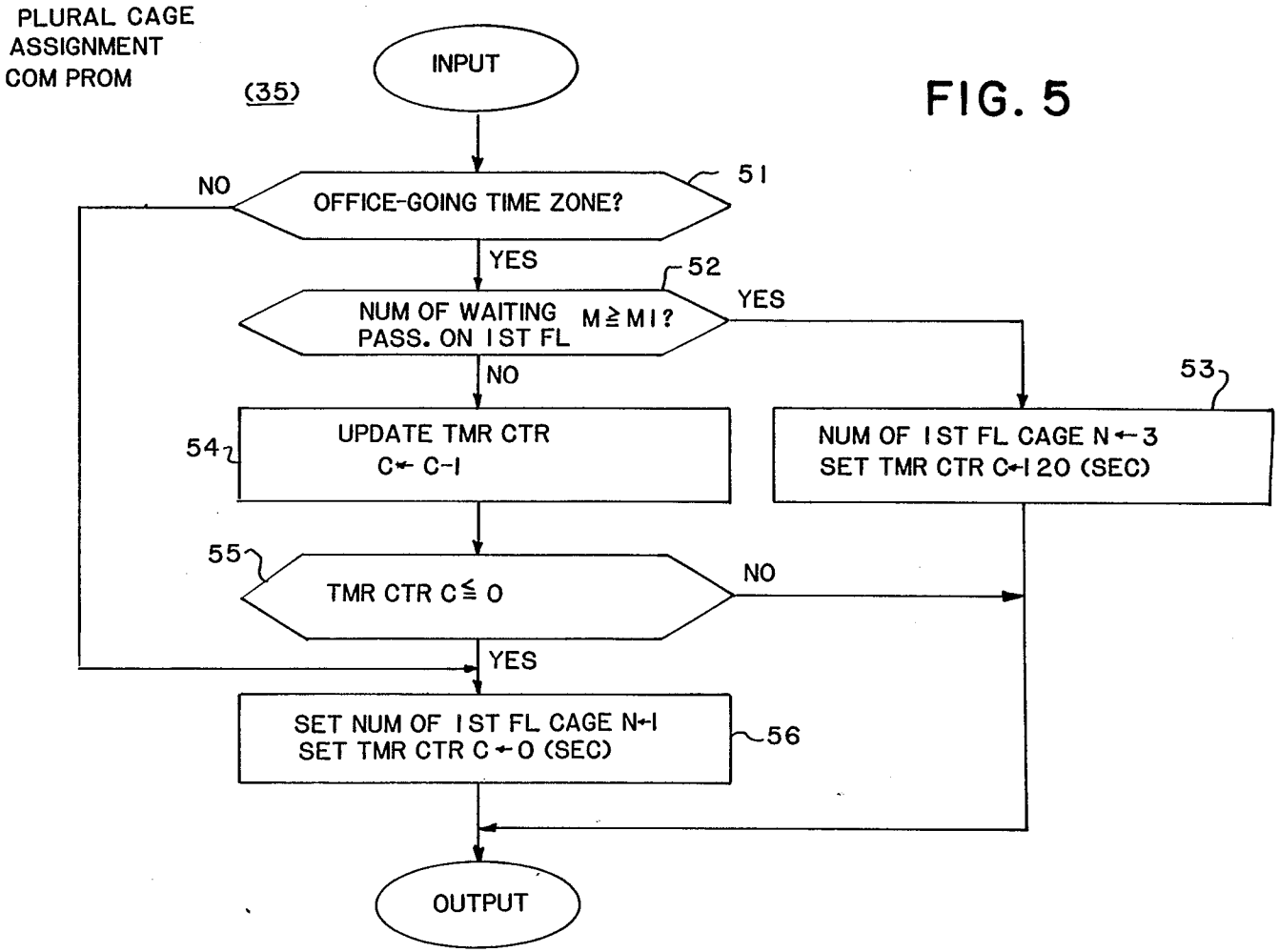
FIG. 5 a flow chart showing a plural cage assignment commanding program.
Figure 6:
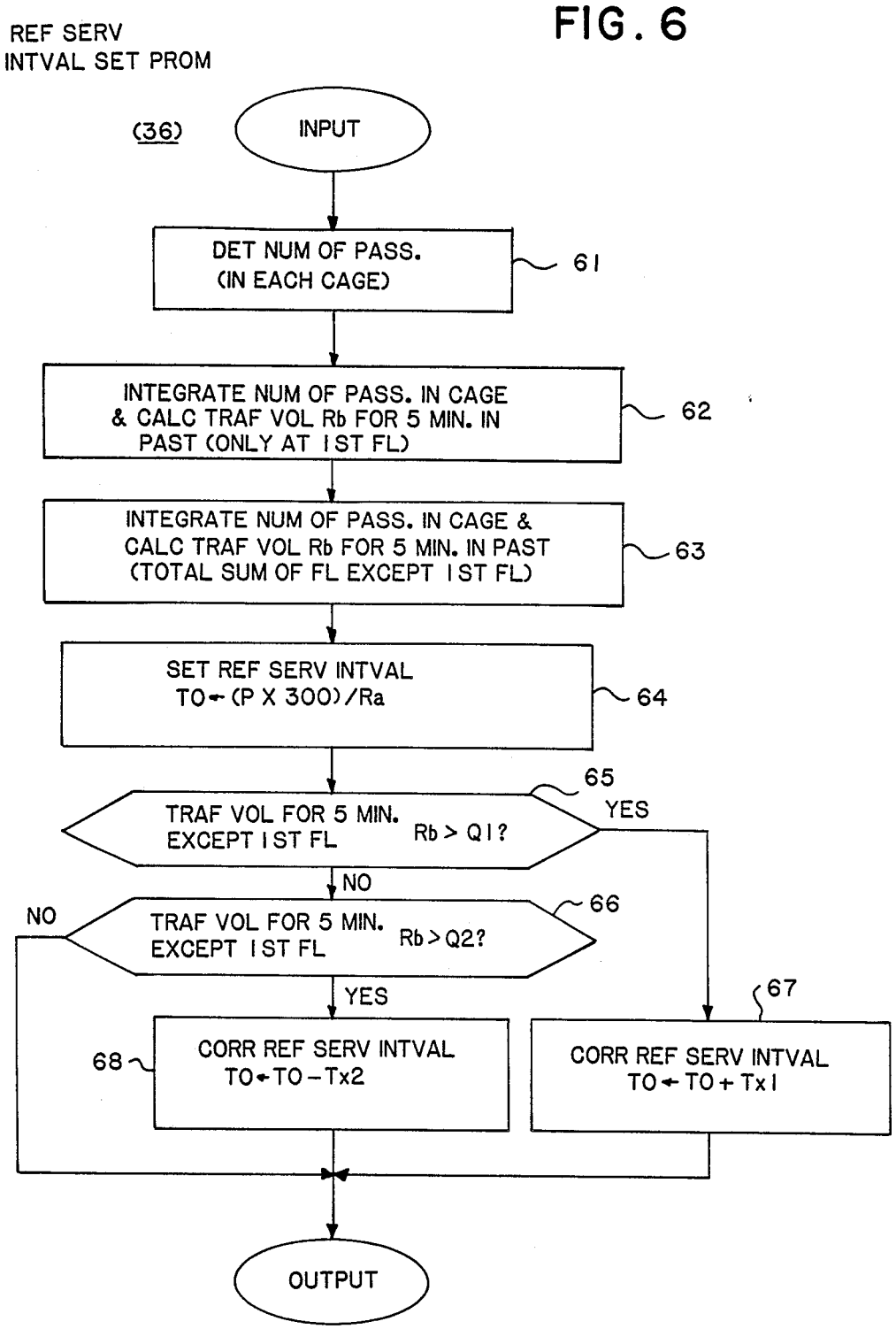
FIG. 6 is a flow chart showing a reference service interval setting program.
Figure 7:
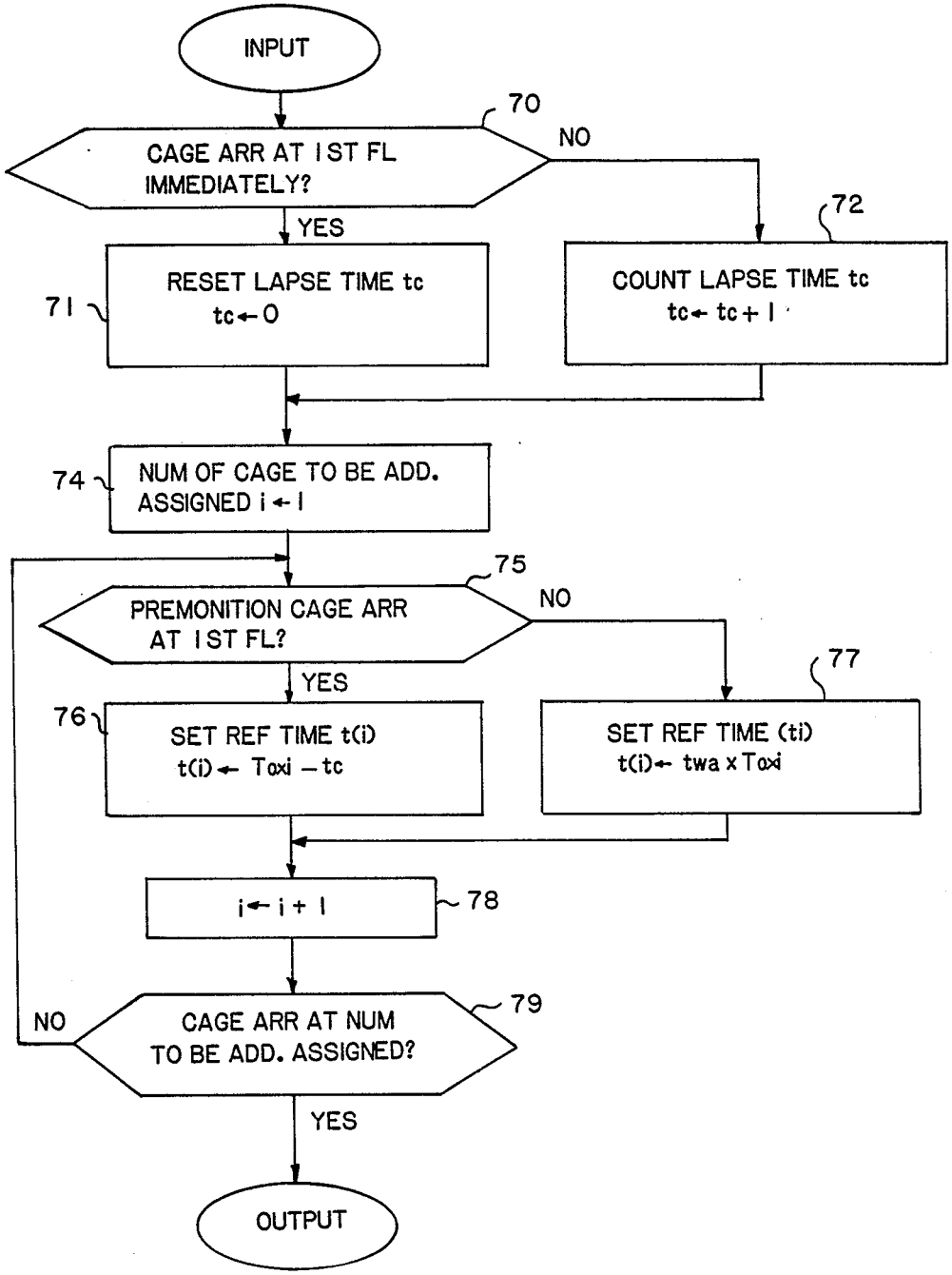
FIG. 7 is a flow chart showing a reference time setting program.

Then, the operation of this embodiment will be described with reference to FIGS. 4 to 8. FIG. 4 is a flow chart showing the group supervisory program stored in the ROM 102 of the MCOM for constructing the group supervisory apparatus 10, FIG. 5 is a flow chart indicating the number-of-plural cages assignment commanding program, FIG. 6 is a flow chart showing similarly the reference service interval setting program, FIG. 7 is a flow chart showing similarly the reference time setting program, and FIG. 8 is a flow chart showing similarly the additional cage assignment program.

The general description of the group supervision will be first described with reference to FIG. 4.

When an input program is executed at a step 31, the hall button signal 19, state signals (cage position, direction, stopping, running, door opening or closing state, cage load, cage call, hall call cancel signal, etc.) from the cage controllers 11 to 18, and a waiting passenger number signal 21 from the congestion degree detector provided on the first floor are inputted as known.

A hall call registration program at a step 32 discriminates the lighting or the light-out of the hall call registration, cancel and hall button lamps, and calculates the continuation time of the hall call as known. It is noted that the hall button lamp of hall assigned with the plural cages is held in a lighting state even if the cages are reached.

The prediction calculating program at a step 33 calculates the arrival predicting time of the cages Nos. 1 to 8 to the halls, the departure predicting times of the respective cages from the respective halls, and the predicted waiting times of the hall calls. The arrival predicting time is calculated, for example, in such a manner that 2 seconds are required for the cage to advance one floor and 10 seconds are required for the cage to stop, and calculated so that the cage is sequentially operated to circulate all the halls in one cycle. The departure predicting time is calculated by adding the predicted time of the stopping time at the hall (e.g., 10 seconds if there is a call of a response schedule and 0 second if there is no call) to the arrival predicting time. The predicted waiting time is calculated by adding the continuation time of the hall call and the arrival predicting time of the assigned cage thereto. The calculations of the arrival predicting time, the departure predicting time and the predicted waiting time are known.

The assignment program at a step 34 selects, assigns and premonishes one best cage to the hall call to which no cage is assigned. For example, with the total sum of the predicted waiting times of all the hall calls when the hall call is assigned to the respective cages as an assignment evaluation value the total sums are obtained for the respective cages, and the hall call is assigned to the cage which has the minimum assignment evaluation value as known. When the premonition cage responds to the hall call, the arrival premonition lamp is switched from the lighting state to a flashing state to inform the arrival, and the assignment of the respective cages and the command of the premonition are held immediately before the cage door is completely closed after the cage door is opened, and again started to close. Therefore, if the assignment and the premonition are cancelled immediately before the premonition cage door is completely closed to the hall call to which the assignment of a plurality of cages is commanded, one cage which has the minimum arrival predicting time of the remaining assigned cages is selected and selected to the premonition cage.

The plural cage assignment commanding program at a step 35 commands to assign a plurality of cages to the 1st-floor up call when it detects the congestion of the first floor.

The reference service interval setting program at a step 36 detects the traffic volumes at the first floor and the floors except the first floor, set a reference service interval to the first floor in response to the traffic volume at the first floor, and further corrects the reference service interval in response to the traffic volumes except the first floor.

The reference time setting program at a step 37 sets a reference time to the arrival time of the cage to be additionally assigned to the first floor on the basis of either the lapse time from the arrival of the cage which eventually becomes the arrival state at the first floor or the arrival predicting time of the assigned cage premonished for the 1st-floor up call (hereinbelow termed "premonition cage") and the reference service interval.

The additional assignment program at a step 38 selects the cages each of which has a minimum deviation between the arrival predicting time to the first floor and the reference time in number to be additionally assigned, and assigns them. The cages to be additionally assigned are not premonished.

The output program at a step 39 outputs the hall button lamp signal 20, the assignment signal, the premonition signal, etc., as known. The group supervisory program is executed once for one second in this sequence.

Then, the operation of the plural cage assignment program 35 will be described with reference to FIG. 5.

A step 51 discriminates whether it is an office-going time zone or not and a step 52 discriminates whether the first floor is congested or not. A step 56 sets "one (cage)" at the number N of the cages to be assigned for the 1st-floor up call except the office-going time zone, and resets a timer counter C for cancelling the plural cage assignment command to "0 (sec.)". At the office-going time zone, when the number M of the waiting passengers on the first floor becomes a predetermined value $M_1$ (e.g., 20 persons) or more, the program advances from the step 52 to a step 53, sets the number N of the cages to be assigned on the first floor to "3 (cages)", and sets the timer counter C to "120 (sec.)". Thereafter, a plurality of the cages are assigned. If the number M of the waiting passengers on the first floor continues the state less than the predetermined value $M_1$ after the assignment of the plurality of cages is commanded, a step 54 reduces one second from the timer counter C. When a step 55 detects that the timer counter C becomes 0 second or less, the step 56 sets the number N of the cages to be assigned to "1 (cage)", and cancels the plural cage assignment command. When the office-going time zone is finished, the plural cage assignment command is similarly cancelled.

Then, the operation of the reference service interval setting program 36 will be described with reference to FIG. 6.

A step 61 obtains the number of passengers in the cage in response to the increase or decrease in a cage load signal detected by a cage floor weighing unit every time the cage stops. A step 62 integrates the number of the passengers in the cage at the first floor and obtains the traffic volume Ra (persons/5 min.) for 5 min. in the past. A step 63 similarly integrates to totalize the number of the passengers except the first floor at each floor except the first floor, and obtains the traffic volume Rb (persons/5 min.) for 5 min. in the past. A step 64 sets the number of passengers corresponding to the passenger capacity $P_0$ of the cage (=20) to a predetermined value P, and further sets a reference service interval $T_0$ on the basis of the traffic volume Ra for 5 min. at the first floor. The reference service interval $T_0$ means that the efficient transportation can be performed by the distribution of the cages of the minimum number without causing waiting passengers to remain at the first floor due to full capacity of the cages when the cages are sequentially arrived at this interval at the first floor.

Steps 65 to 68 correct the reference service interval $T_0$ set in response to the traffic volume Ra discriminated at the traffic volume Rb except the first floor by predetermined values $Q_1$, $Q_2$ ($Q_1$ larger than $Q_2$), and when the traffic volume of the floor except the first floor is so many in the degree that the traffic volume Rb is larger than the predetermined value $Q_1$, the program advances from the step 65 to the step 67, and resets the reference service interval $T_0$ to a value longer by a predetermined value Tx1 (=10 sec.) than that. Thus, the distribution of the cages to the first floor is delayed, the service of the cages to the other floors corresponding to this distribution can be strengthened to prevent the service from being deteriorated. When the traffic volume of the floors except the first floor is so small in the degree that the traffic volume Rb is smaller than the predetermined value $Q_2$, the program advances from the step 65 to the step 66, and the step 68, and resets the reference service interval $T_0$ earlier by a predetermined value Tx2 (=15 sec.). Thus, the distribution of the cages to the first floor is advanced, the service of the residual cages to the first floor is strengthened to improve the service. In this manner, the optimum reference service interval $T_0$ is set.

Then, the operation of the reference time setting program 37 will be described with reference to FIG. 7.

Steps 70 to 72 calculate the lapse time from the arrival of the cage finally arrived at the first floor. The step 70 first discriminates whether there is any cage which is arrived at the first floor immediately thereafter or not. If there is the cage arrived immediately thereafter, the step 71 resets the lapse time $t_c$ to "0 (sec.)". If there is no cage arrived immediately thereafter, the step 72 counts up the lapse time $t_c$ by "1 (sec.)". Thus, the lapse time $t_c$ is calculated after the cage is finally arrived at the first floor.

Then, a step 74 initially sets a variable i representing the number of cages to be additionally assigned to "1 (cage)". Then, a step 75 discriminates whether the 1st floor up call premonition cage is arrived at first floor or not. If the premonition cage is arrived at the first floor, a step 76 sets the lapse time $t_c$ to a negative value, adds the product of the reference service time $T_0$ and the i to the negative value, and set the sum as the reference time t(i) for the i-th cage to be additionally assigned. If the premonition cage is not arrived at the first floor, a step 77 adds the production of the reference service time $T_0$ and the i to the arrival predicting time twa of the premonition cage at the first floor, and sets the sum as the reference time t(i) for the i-th cage to be additionally assigned. The arrival predicting time twa of the premonition cage at the first floor uses the arrival predicting time calculated by the predicting calculation program 33. A step 78 increases the number i of the cages to be additionally assigned by "1", and a step 79 discriminates whether reference times t(i) (i=1, . . . , N-1) for all the cages to be additionally assigned are set or not, and and ends the execution of this program when they are all set completely.

The operation of the additional cage assignment program 38 will be described with reference to FIG. 8.

A step 81 discriminates whether there is the cage premonished to the 1st floor up call or not and whether the number N of the cages to be assigned at the first floor are 2 or more or not. If the assignment of a plurality of cages is commanded, a step 82 cancels the 1st up assignment of all the cages except the premonition cages. This is because the cages to be additionally assigned so far are not always optimal with respect to the reference time at present according to the variation of the state, and the assignment is again rechecked so as to always select the optimal additional assignment of the cages.

A step 83 initializes to select the additional assignment of cages. In other words, the program sets the variable i representing the number of cages to be additionally assigned to "1", the variable j representing the number of the cages Nos. to "1", and the minimum value of a deviation between the reference time and the arrival predicting time and the temporary variables x, y representing the number of the cages Nos. to "999" and "1", respectively. Then, steps 84 to 94 select the 1 to (N-1)-th cages to be additionally assigned.

The step 84 first discriminates the assigned cages for the 1st up call and removes the assigned cages from the selection of the cages to be additionally assigned. The step 85 also extracts the cage to be predicted to arrive previously at the first floor as compared with the premonition cage from the selection of the cages to be additionally assigned. If the cage j is selected for the cage to be additionally assigned when the arrival predicting time ta(j) of the cage j is smaller than the arrival predicting time twa of the premonition cage, the premonition is easily mistaken (the cage except the premonition cage arrives previously) to causes the passengers waiting in front of the premonition cage to be bothered. This adds such a selecting condition to prevent the premonition from being mistaken.

The step 86 discriminates whether a deviation $|t(i)-ta(j)|$ between the reference time t(i) for the i-th cage to be additionally assigned and the 1st arrival predicting time ta(j) of the cage j not yet assigned is the minimum of the cages discriminated so far or not. If the deviation $|t(i)-ta(j)|$ is smaller than the minimum value x, the step 87 resets the minimum value x of the deviation by $|t(i)-ta(j)|$, and simultaneously sets and stores the cage No. y of the minimum at this time to "j". The step 88 then increases by one the cage No. j, and the step 89 discriminates whether all the cage Nos. (j=1 to 8) have finished the processes of the steps 84 to 88 or not. If the above processes are not yet finished at all the cages Nos., the program returns to the step 84, and executes the similar processes. If the above processes are all finished at all the cages Nos., the step 90 assigns the cage y of the cage having the minimum deviation to the 1st floor up call as the i-th cage to be additionally assigned. Then, it increases the number i of the cages to be additionally assigned by "1" so as to select the next (i+1)-th cage to be additionally assigned, sets the number j of the cage No. to "1", the minimum value x to "999", and initializes the minimum cage No. y to "1".

The step 91 again returns to the step 84 if the number i of the cages to be additionally assigned does not arrive at the number N of the cage to be assigned, and then selects the next cage to be additionally assigned. This is repeated until the number i of the cages to be additionally assigned arrives at the number N of the cages to be assigned.

As described above, the additional assignment program 39 selects the cages to be additionally assigned by the reference different from the assignment program 34.

In this embodiment as described above, when the congestion of the hall at the first floor is detected, the reference service interval is set in response to the traffic volume at the first floor and the traffic volumes at the floors except the first floor, the reference time for the arrival time at the first floor is set corresponding to the number of the cages to be additionally assigned on the basis of the reference service interval and the first state time of the predetermined cage (the lapse time from the arrival of the cage finally arrived at the first floor, or the arrival predicting time of the 1st floor up call premonition cage), and the cage having small deviation between the 1st floor arrival predicting time and the reference time is selected as the cage to be additionally assigned. Therefore, the cages are not arrived concentratively at the first floor to be serviced to improve the transportation efficiency when the first floor is congested, thereby shortening the waiting times of the first floor and the other floors.

As described above, the first embodiment of the present invention provides the group supervisory apparatus for the elevator for assigning a plurality of cages for the hall of congestion when the congestion of the hall is detected comprising the predicting time calculating means for calculating the predicting time until the cage becomes the predetermined state in the hall of congestion, the reference service interval setting means for setting the reference value (reference service interval) of the period from when the cage to be serviced previously in the hall of congestion becomes the first state to when the cage to be similarly serviced lately becomes the second state in response to the traffic volume of the hall of congestion, the reference time setting means for setting the reference value (reference time) of the time that the other cage becomes the second state in the hall of congestion in response to the number of cages to be additionally assigned on the basis of the reference service interval and the first state time of the predetermined cage, and the additional assignment means for selecting and assigning the cage having small deviation between the second state predicting time for the hall of congestion and the reference time as the cage to be additionally assigned. Therefore, the plurality of cages to be assigned are not serviced concentratively in the hall of congestion to improve the transportation efficiency of the hall of congestion, thereby shortening the waiting time of the passengers.

A second embodiment of the present invention will be described with reference to FIGS. 9 to 18.

Figure 9:
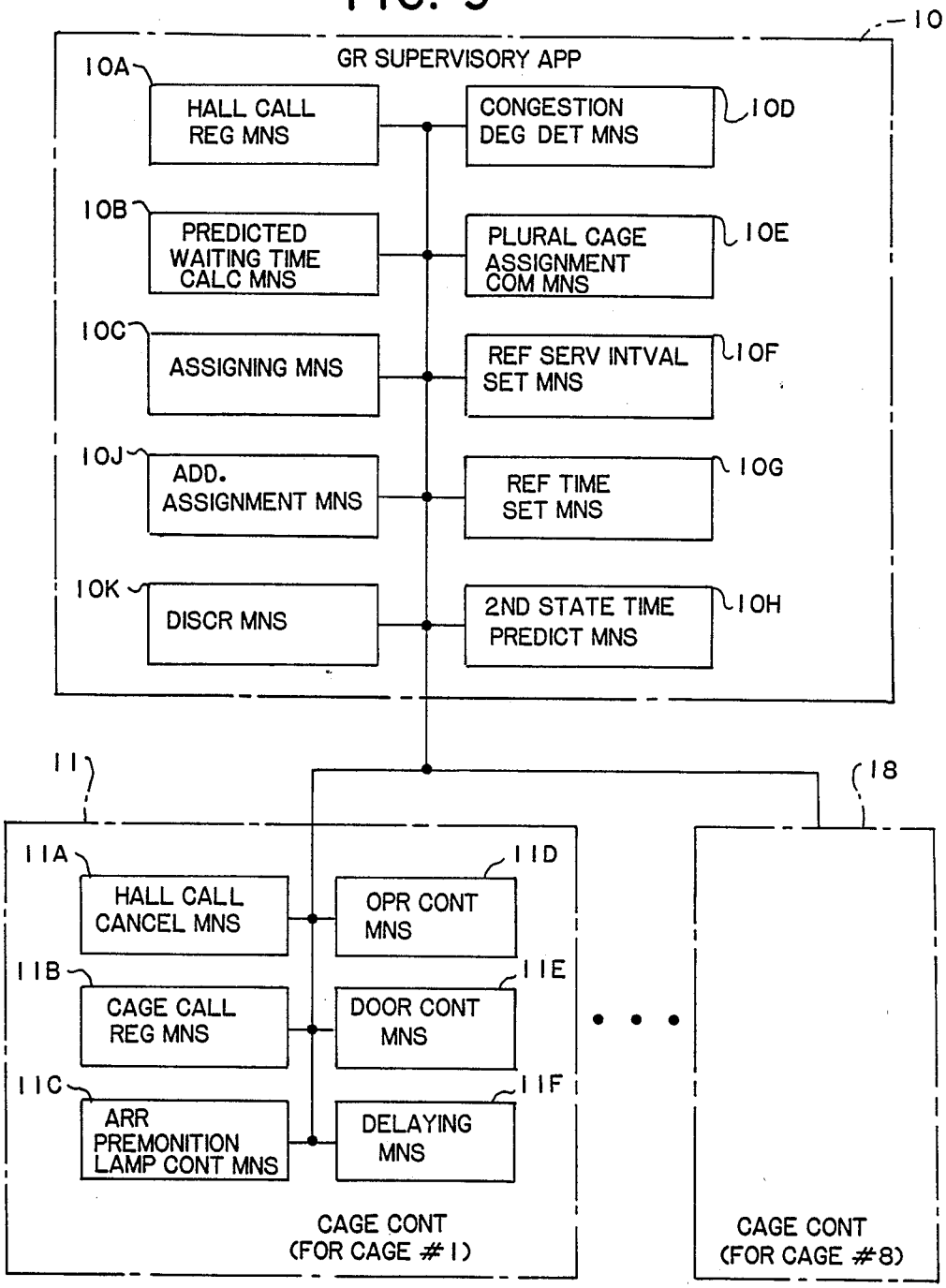
FIG. 9 is a view of an entire arrangement of a second embodiment of a group supervisory apparatus for an elevator according to the present invention.

FIG. 9 is a view of an entire arrangement of a group supervisory apparatus of the second embodiment, wherein the same symbols as those in FIG. 1 indicate the same or equivalent components. The arrangement of the group supervisory apparatus 10 is the same as that in FIG. 3.

In the drawings, symbol 10K denotes discriminating means for discriminating whether a delaying operation is commanded to the cage to be additionally assigned to output an arrival delay command signal. The times are always set at present time point as a starting point to be the time in the group supervision.

Symbol 11F denotes delaying means for handling the arrival delay command signal equivalently to a cage call registration signal to output a cage call stop command signal together with the cage call registration signal.

Figure 10:
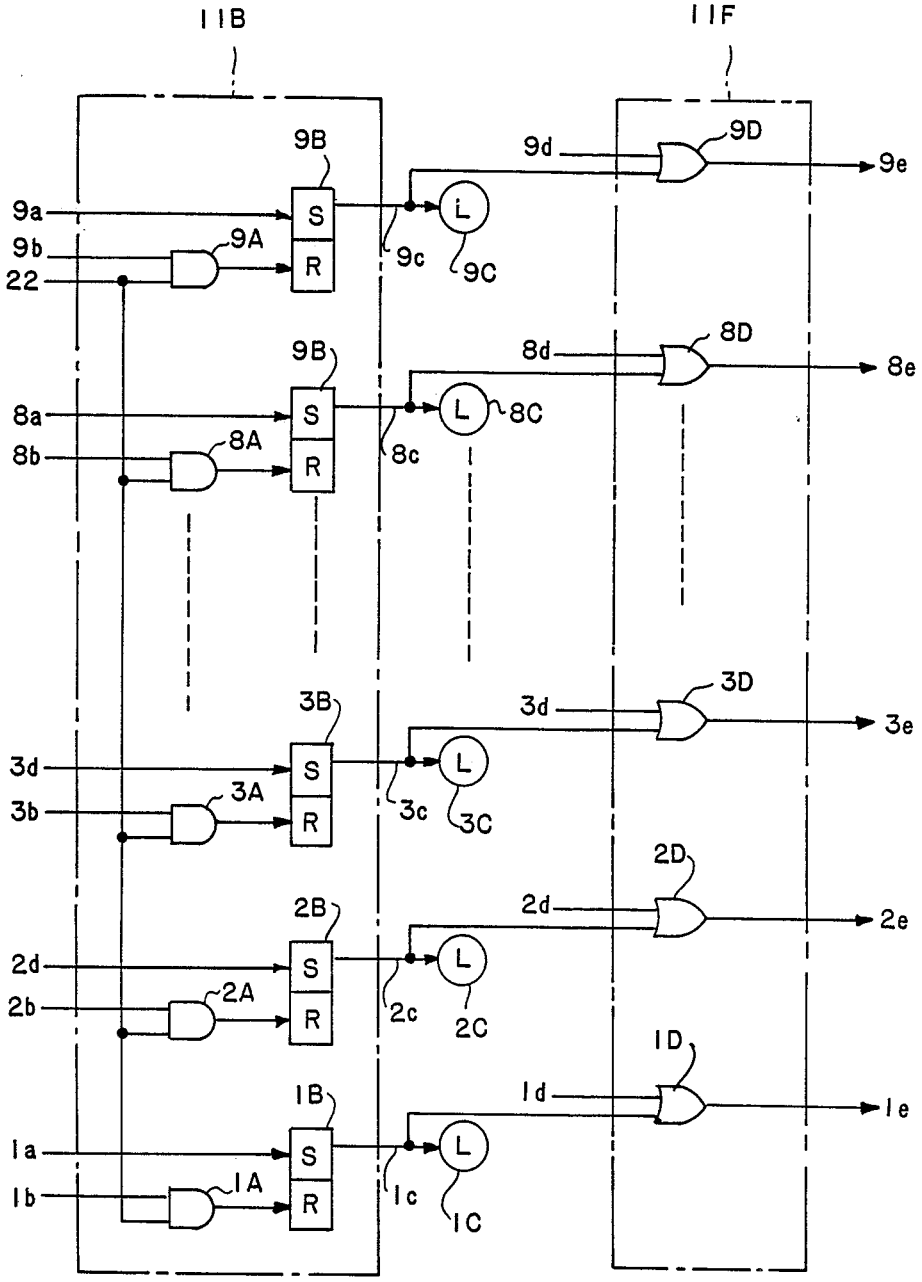
FIG. 10 is a logic circuit diagram of cage call registration means and delaying means.
Figure 11:
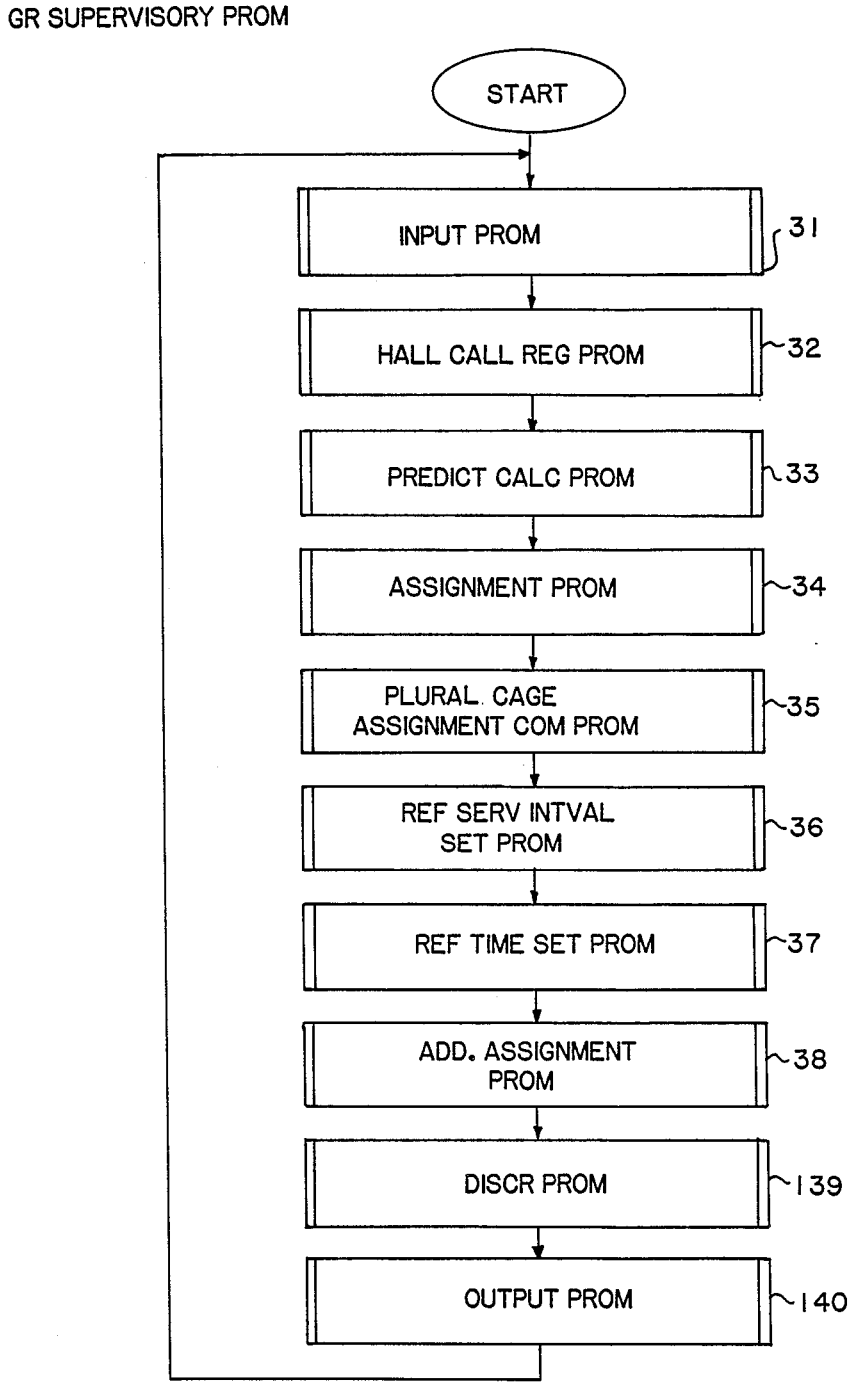
FIG. 11 is a flow chart of a group supervisory program.
Figure 12:
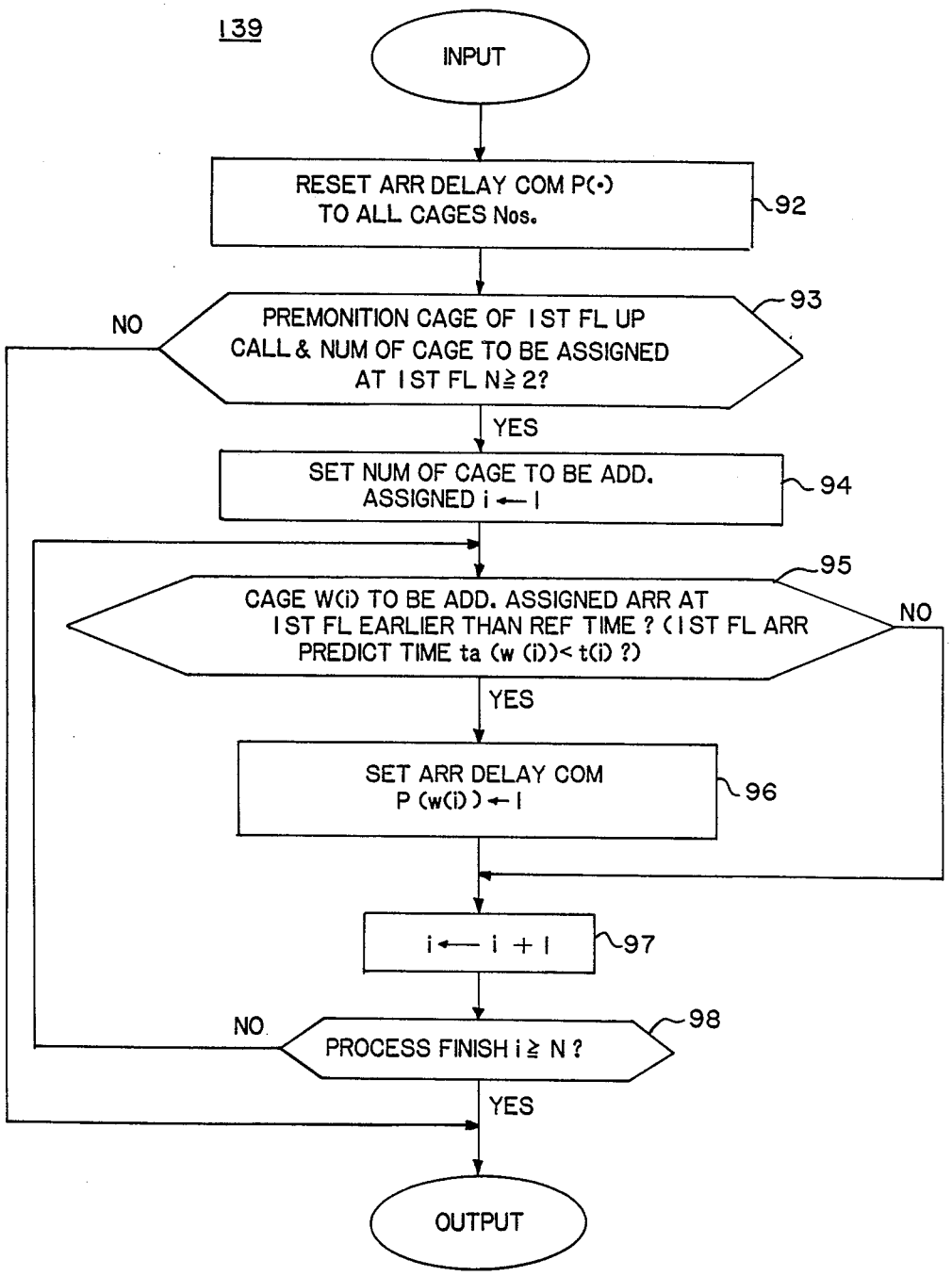
FIG. 12 is a flow chart of a discriminating program.

Then, the operation of the second embodiment will be described with reference to FIGS. 10 to 12. FIG. 10 is a logic circuit diagram showing the cage call registration means 11B and delaying means 11F for the cage No. 1. Symbols **1*a* to 9*a* denote destination button signals which become "H" when first to ninth floor designation buttons (not shown) are depressed in the respective cages, symbols 1*b* to 9*b* denote cage position signals which become "H" when the cages are located at the first to ninth floors, respectively, symbols 1*c* to 9*c* denote cage call registration signals which become "H" when the cage calls at the first to ninth floors are registered, symbol 1*d* to 9*d* denote arrival delay command signals which become "H" when inputted from the group supervisory apparatus 10 and forcibly stopped at the first to ninth floors, respectively, symbols 1*e* to 9*e* denote cage call stop command signal which become "H" when the cages are stopped at the first to ninth floors by the cage calls, symbols 1A to 9A denote AND gates, symbols 1B to 9B denote R-S flip-flops (hereinbelow termed "memories"), symbols 1C to 9C denote cage call registration lamps contained in the first to ninth floor destination buttons, and symbols 1D to 9D denote OR gates, and numeral 22 denotes a stopping signal which becomes "H" when the cage is stopped at the floor and "L" except it. FIG. 11 is a flow chart showing a group supervisory program stored in ROM 102 of MCOM of the group supervisory apparatus 10, and FIG. 12** is a flow chart similarly showing the discriminating program.

The general operation of the group supervisory will be first described with reference to FIG. 11. Steps 31 to 38 are similar to those in the first embodiment in FIG. 4, and the description thereof will be omitted.

The discriminating program of a step 139 discriminates whether a delaying operation is commanded to each cage to be additionally assigned or not to output an arrival delay command signal.

The output program of a step 140 outputs a hall button lamp signal 20, an assignment signal, a premonition signal, etc. as known.

The group supervisory programs 31 to 39, 139, 140 are executed once per one second in this sequence.

The operation of the plural cage assignment program 35, the operation of the reference service interval setting program 36, the reference time setting program 37, and the operation of the additional assignment program 38 are the same as those described with reference to FIGS. 5 to 8, and the descriptions thereof will be omitted.

Then, the operation of the discriminating program 139 will be described with reference to FIG. 12.

A step 92 resets the arrival delay commands p(i) (i=1, 2, . . . , 8) for all cages Nos. to "0". A step 93 discriminates whether there is the cage premonished for the 1st up call or not and whether the number N of the cages to be assigned at the first floor is two or more or not. If the assignment of a plurality of cages is commanded for the first floor, a step 94 initializes the variable i representing the number of the cages to be additionally assigned to "1".

Steps 95 to 98 discriminate whether a delaying operation is necessary for (N-1) of the cages w(i) (i=1, 2, . . . , N-1) to be additionally assigned or not. The step 95 discriminates whether the i-th cage w(i) to be additionally assigned is predicted to arrive at the first floor earlier than the reference time t(i) or not. If the arrival predicting time ta (w(i)) of the cage w(i) to be additionally assigned is smaller than the reference time t(i), the step 96 sets the arrival delay command p (w(i)) to "1". The step 97 increases the number i of the cages to be additionally assigned by "1" so as to discriminate the delaying operation of the number i of the next (i+1)-th cage to be additionally assigned, and if the step 98 discriminates that the number i of the cages to be additionally assigned does not arrive at the number N of the cages to be assigned, the program again returns to the step 95 to discriminate whether the delaying operation for the next cages to be additionally assigned is needed or not. This operation is repeated until the number i of the cages to be additionally assigned arrives at the number N of the cages to be assigned.

Finally, the forcible stop of the cage according to the ordinary cage call registration and the arrival delay command signal will be described with reference to FIG. 10.

If a passenger depresses a third destination button in the cage, the destination button signal 3*a* becomes "H", the memory 3B is set to register a call call, and the cage call registration signal 3*c* becomes "H" to light the cage call registration lamp 3C. Then, the cage call stop command signal 3*e* of the output of the OR gate 3D becomes "H", and the cage is run to the third floor and stop at the third floor by the operation control means 11D. When the cage is stopped, the stopping signal 22 becomes "H", but since the third floor cage position signal 3*b* becomes "H" at this time, the output of the AND gate 3A becomes "H" to reset the memory 3B. Thus, the cage call registration lamp 3C is put out, and the cage call stop command signal 3*e* becomes "L". These operations are as usual.

Then, when the third arrival delay command signal 3*d* is generated by the discriminating program 39 to become "H", the OR gate 3D is opened, the third floor cage call stop command signal 3*e* becomes "H", and the cage additionally assigned is stopped similarly at the third floor to the ordinary operation. In other words, the cage additionally assigned is stopped in response to the assumed third cage call. If the condition of the discriminating program 39 is not satisfied, the arrival delay command signal 3*d* becomes "L". Thereafter, the cage additionally assigned passes the floor having no cage call.

In the second embodiment as described above, when the congestion of the first floor hall is detected, the reference service interval is set in response to the traffic volume at the first floor and the traffic volume at the floors except the first floor, the reference time for the arrival time to the first floor is set in response to the number of the cages to be additionally assigned on the basis of the reference service interval and the first state time of the predetermined cage (the lapse time from the arrival of the cage finally arrived at the first floor, or the arrival predicting time of the premonition cage of the 1st up call), and the cage having the small deviation between the arrival predicting time at the first floor and the reference time is selected as the cage to be additionally assigned. When the fact that the arrival predicting time of the cage to be additionally assigned is earlier than the reference time is detected, the arrival delay command is produced to forcibly stop the cage to be additionally assigned at the floor having neither cage call nor assignment hall call. Accordingly, the cages are not concentratively arrived at the first floor to be serviced, and the transportation efficiency when the first floor is congested can be improved to shorten the waiting time at the other floors.

Figure 13:
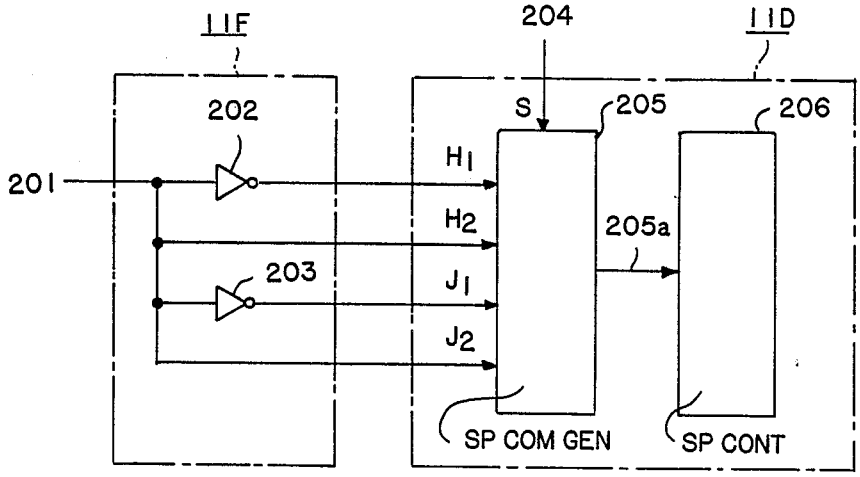
FIG. 13 a view showing a third embodiment of a group supervisory apparatus for an elevator according to the present invention to illustrate a logic circuit diagram of operation control means and delaying means.

FIG. 13 is a block diagram of delaying means 11F and operation control means 11D of a third embodiment of a group supervisory apparatus according to the present invention. The third embodiment of the invention decreases the maximum speed and the acceleration/deceleration of the cage to be delayed.

In FIG. 13, numeral 201 denotes an arrival delay command signal which becomes "H" when any of the arrival delay command signals 1*d* to 9*d* in FIG. 10 becomes "H", numerals 202 and 203 denote NOT gates, numeral 204 denotes a run command signal which becomes "H" when the cage is started to run and "L" when the cage is stopped, numeral 205 denotes a speed command generator for generating a speed command signal 205*a* of the maximum speed and the acceleration/deceleration corresponding to terminals $H_1$, $H_2$ and $J_1$, $J_2$ when the run command signal 204 inputted to a terminal S becomes from "L" to "H". The terminals $H_1$, $H_2$ correspond to 150 m/min. and 90 m/min. of the maximum speed, and the terminals $J_1$, $J_2$ correspond to 0.9 m/sec$^2$ and 0.8 m/sec$^2$ of the acceleration/deceleration. Numeral 206 denotes a speed controller for controlling the speed of the cage according to the speed command signal 205*a*.

More specifically, since the arrival delay command signal 201 is ordinarily "L", the outputs of the NOT gates 202 and 203 are all "H", and the inputs of the terminals $H_1$, $J_1$ of the speed command generator 205 becomes "H". Thus, the speed command generator 205 outputs the speed command signal 205*a* corresponding to the input, and the cage is operated by the speed controller 206 at 150 m/min of the maximum speed and 0.9 m/sec$^2$ of the acceleration/deceleration.

When the cage No. 1 of the cage to be additionally assigned for the 1st up call is predicted to arrive earlier than the reference time, the arrival delay command signal 201 becomes "H". Accordingly, the inputs of the terminals $H_2$, $J_2$ of the speed command generator 205 become "H". Thus, the cage No. 1 is operated at 90 m/min of the maximum speed and 0.8 m/sec$^2$ of the acceleration/deceleration to increase its running time. Therefore, since the arrival of the cage at the first floor is delayed, the cage can be arrived at the first floor as the reference time.

Figure 14:
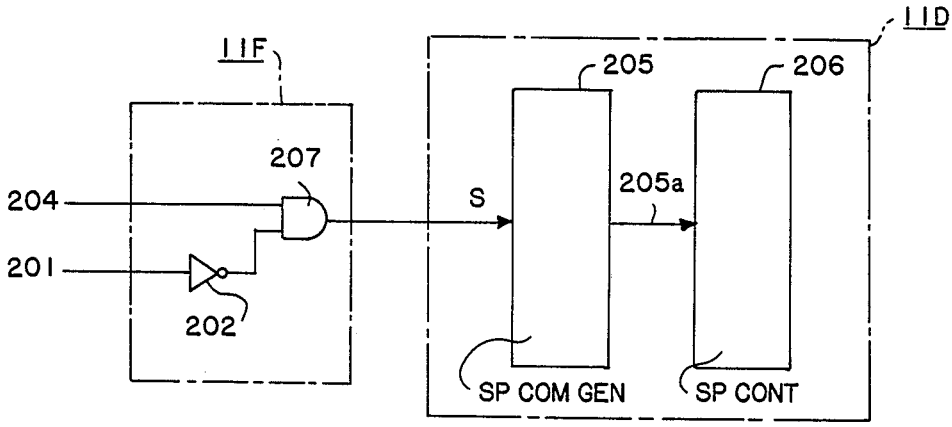
FIG. 14 is a view of a fourth embodiment of a group supervisory apparatus for an elevator according to the present invention to illustrate a logic circuit diagram of operation control means and delaying means.

FIG. 14 is a block diagram showing delay means 11F and operation control means 11D of a fourth embodiment of a group supervisory apparatus according to the present invention. The fourth embodiment of the invention stop departing of the cage to be delayed.

In FIG. 14, numeral 207 denotes an AND gate, and the other components are similar to those in FIG. 13. More specifically, since an arrival delay command signal 201 is ordinarily "L", the output of an NOT gate 202 becomes "H". Accordingly, when a run command signal 204 becomes from "L" to "H", the output of the AND gate 207 becomes "H". Since this output is inputted to the terminal S of a speed command generator 205, the speed command generator 205 outputs a predetermined maximum speed (e.g., 150 m/min.) and a speed command signal 205*a* responsive to the acceleration/deceleration (e.g., 0.9 m/sec$^2$), and the cage is operated at the speed by a speed controller 206.

When the cage No. 1 of the cage to be additionally assigned for the 1st up call is predicted to arrive earlier than the reference time, the arrival delay command signal 201 becomes "H", and the output of the NOT gate 202 becomes "L". Since the output of the AND gate 207 always becomes "L" even if the run command signal 204 becomes "H", the running of the cage is stopped. Therefore, since the arrival of the cage at the first floor is delayed, the cage can be arrived as the first floor as the reference time.

Figure 15:
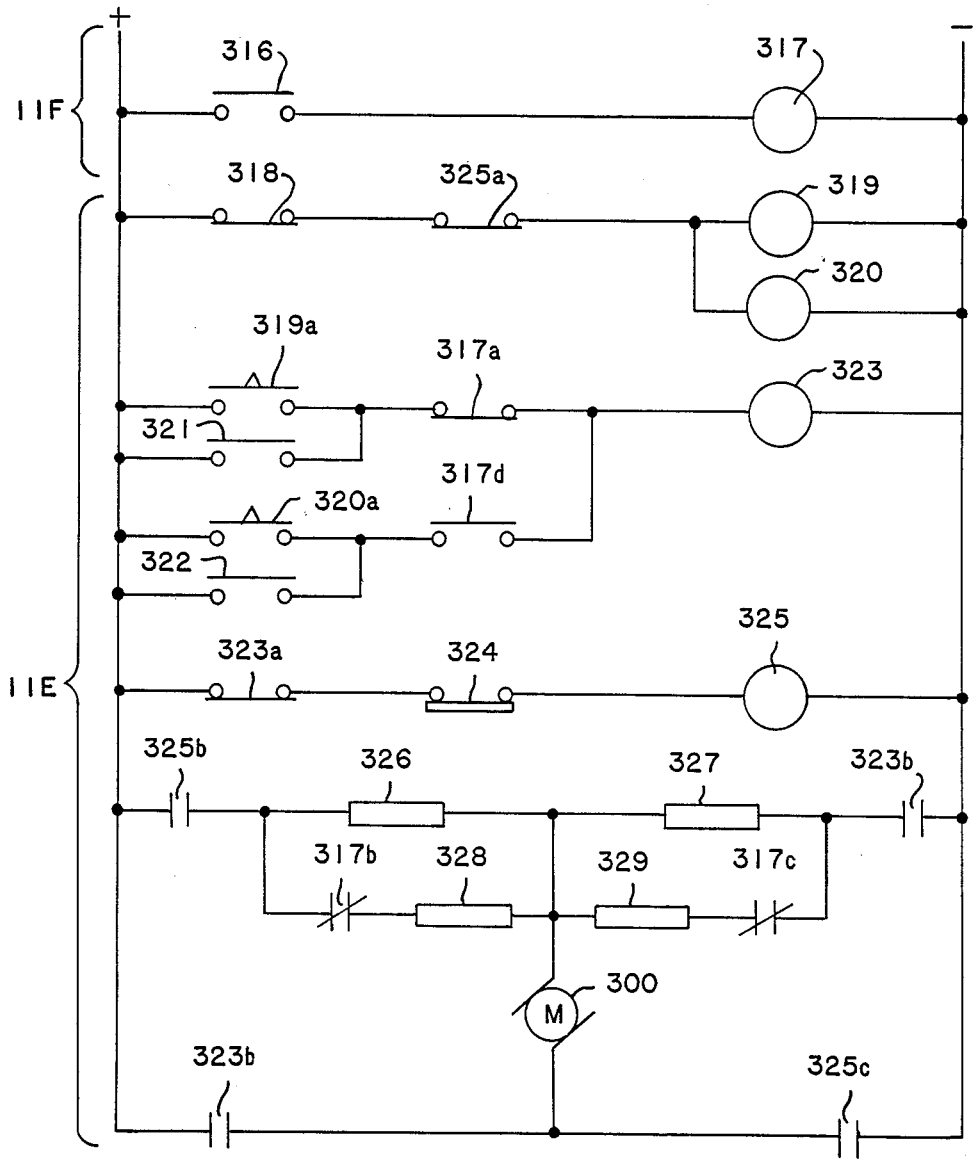

FIGS. 15 and 16(*a*) and 16(*b*) show a fifth embodiment of a group supervisory apparatus according to the present invention. FIG. 15 shows a relay circuit diagram of delay means 11F and door control means 11E to increase the time required for opening or closing a cage door to be delayed as compared with the usual time.

In the drawings, symbols (+) and (−) denote DC power source, numeral 316 denotes an arrival delay command relay contact closed when the arrival delay command signal is outputted from the group supervisory apparatus 10, numeral 317 denotes a delay operation switching relay, symbols 317*a* to 317*c* denote its normally closed contacts, symbol 317*d* denotes a normally open contact, numeral 318 denotes a run relay contact opened while the cage is being run, numeral 319 denotes a door opening time setting time limiting relay which is operated after a predetermined time (e.g., 2 se.) when energized and immediately reset when deenergized, symbol 319*a* denotes its normally open contact, numeral 320 denotes a door opening time setting time limiting relay set similarly to 4 sec., symbol 320*a* denotes its normally open contact, numeral 321 denotes a prelanding detection relay contact closed while a cage floor arrives at a point of a predetermined distance (e.g., approx. 75 mm) from the floor to be stopped at after the cage is started, numeral 322 denotes a floor stopping detection relay contact closed while the cage is similarly stopped at the floor to be stopped at, numeral 323 denotes a door closing relay, symbols 323*a* denotes its normally closed contact, symbols 323*b* and 323*c* denote normally open contacts, numeral 324 denotes a fully-open detection switch opened when the cage door is fully opened, numeral 325 denotes a door opening relay, symbol 325*a* denotes its normally closed contact, symbols 325*b* and 325*c* denote similarly normally open contacts, numerals 326 to 329 denote resistors, and numeral 330 denotes an armature of a motor for driving the cage door (a field of the motor is omitted).

Then, the operation of the fifth embodiment will be described.

Since the arrival delay command relay contact 316 is ordinarily opened, the delay operation switching relay 317 is deenergized, the contacts 317*a* to 317*c* are closed, and the contact 317*d* are opened.

Assume now that, while the cage No. 1 is being run down at the fifth floor, it responds to the cage call at the fourth floor. At this time, since the prelanding detection relay contact 321 is closed, the door closing relay 323 is energized in the circuit of (+) DC power source, the relay 321, the contact 317*a*, the relay 323 and (−) DC power source, the contact 323*a* is opened, and the contacts 323*b* and 323*c* are closed. The door opening relay 325 is deenergized by the opening of the contact 323*a*, and the contact 325*a* is closed. Since the run relay contact 318 is opened, the relays 319 and 320 for limiting the door opening time setting time are together deenergized. A current flows to the armature 330 by the circuit of the (+) DC power source, the contact 323*c*, the armature of the motor, through the resistor 327 or the resistor 329 and the contact 317*c*, the contact 323*b* and the (−) DC power source by the closure of the contacts 323*b* and 323*c*. The door is pressed at the closed position in a door closing direction.

When the cage No. 1 approaches the fourth floor, it starts decelerating, and when the cage No. 1 arrives at a point 75 mm before the fourth floor, the prelanding detection relay contact 321 opens. Thus, the door closing relay 323 is deenergized, the contact 323*a* is closed, and the contacts 323*b* and 323*c* are opened. The door opening relay 325 is energized by the closure of the contact 323*a*, the contact 325*a* is opened, and the contacts 325*b* and 325*c* are closed. Thus, since a current flows to the armature 330 reversely to the previous current in the circuit of the (+) DC power source, the contact 325*b*, through the resistor 326 or the contact 317*b* and the resistor 328, the armature 330, the contact 325*c* and the (−) DC power source, the door starts opening. The run relay contact 318 is closed by the stop of the cage No. 1, but since the contact 325*a* is already opened, the door opening time setting time limiting relays 319 and 320 are not energized. When the door of the cage No. 1 is completely opened, the fully-open detection switch 324 is opened. Thus, the door opening relay 325 is deenergized, the contact 325*a* is closed, and the contacts 325*b* and 325*c* are opened. The door opening time setting time limiting relays 319 and 320 are energized by the closure of the contact 325*a*, the time limiting relay 319 is operated after 2 seconds, and the contact 319*a* is closed. Thus, the door closing relay 323 is energized in the circuit of the (+) DC power source, the contact 319*a*, the contact 317*a*, the relay 323 and the (−) DC power source, the contacts 323*b* and 322*c* are closed, and the door starts closing. When the door is completely closed, after a slight delay time is elapsed, the cage No. 1 is started to again start running downward. When the cage No. 1 starts running down, the run relay contact 318 is simultaneously opened, the door opening time setting time limiting relays 319 and 320 are deenergized, and the contacts 319*a* and 320*a* are opened. However, since the prelanding detection relay contact 321 is closed at this time, the door closing relay 323 is held. The above-described operation is for delaying the operation of the cage.

Then, when the arrival delay command signal is outputted, the arrival delay command relay 316 is closed, the delay operation switching relay 317 is energized to open the contacts 317*a* to 317*c* and close the contact 317*d*.

In the same manner as described above, assume that the cage No. 1 is now being run down at fifth floor and responds to the cage call at the fourth floor. Since the floor stopping detection relay contact 322 is closed at this time, the door closing relay 323 is energized in the circuit of the (+) DC power source, the contact 322, the contact 317*d*, the relay 323 and the (−) DC power source.

When the age No. 1 approaches the fourth floor to be decelerated and stopped at the cage floor at the fourth floor, the floor stopping detection relay contact 322 is opened. Accordingly, the door closing relay 323 is deenergized. When the contact 323a is closed, the door closing relay 325 is energized similarly to the above to close the contacts 325b and 325c. Since the delay operation switching relay contacts 317b and 317c are now opened, a current flows reversely to the above to the armature 330 in the circuit of the (+) DC power source, the contact 325b, the resistor 326, the armature 330, the contact 325c and the (−) DC power source, and the door starts opening. Since the current becomes smaller than the normal current, the rotating speed of the armature 330, i.e., the door opening speed becomes slower than the usual speed, and the door opening operation takes longer than the normal speed. When the door is fully opened and the contact 325a is closed, the door opening time setting time limiting relays 319 and 320a are energized, the time limiting relay 319 is operated after 2 seconds, the contact 319a is closed, but the contact 317a is opened. Accordingly, there is no variation in the circuit. When 4 seconds are elapsed from the closure of the contact 325a, the time limiting relay 320 is operated, the contact 320a is closed. Thus, the door closing relay 323 is energized slower than the normal speed by the circuit of the (+) DC power source, the contact 320a, the contact 317d, the relay 323 and the (−) DC power source. In this manner, a current smaller than the normal current flows to the armature 330 in the circuit of the (+) DC power source, the contact 323c, the armature 330, the resistor 327, the contact 323b and the (−) DC power source. Therefore, the door closing speed is slower than the normal speed, and the door closing operation takes longer than the normal time.

Figure 16A:
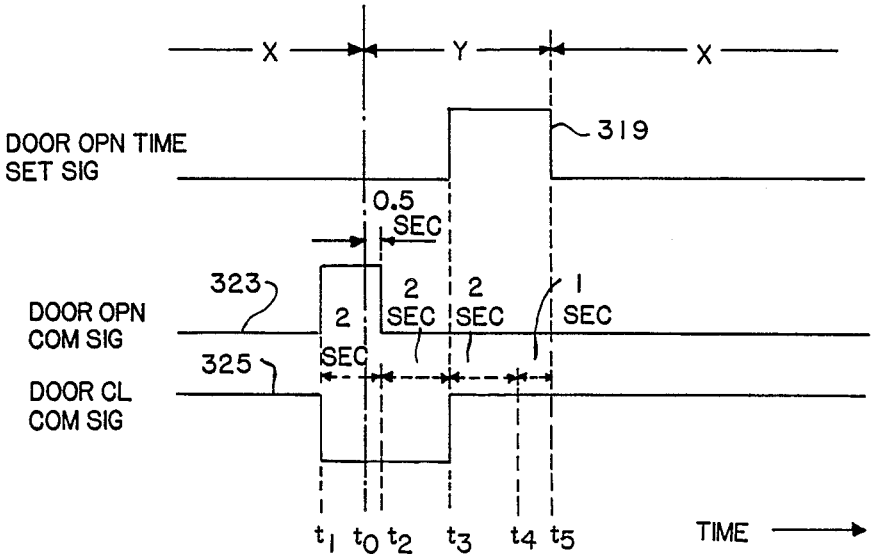
Figure 16B:
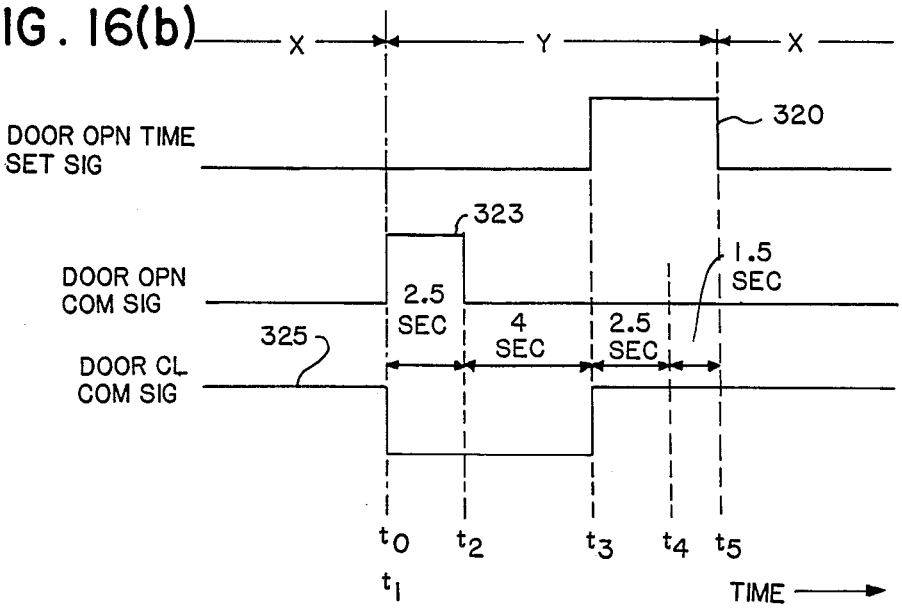

FIGS. 16(a) and 16(b) show door opening and closing time waveforms for explaining the concrete door opening and closing operations when controlled as described above, FIG. 16(a) shows that at the normal operation time, and FIG. 16(b) shows that at the delaying operation time. In FIGS. 16, symbol X denotes the running time of the cage, symbol Y denotes the stopping time of the cage, symbol $t_0$ denotes the time when the cage stops at the hall floor, symbol $t_1$ denotes the door opening or closing starting time, symbol $t_2$ denotes the door fully opening time, symbol $t_3$ denotes the door closing starting time, symbol $t_4$ denotes the door fully closing time, and symbol $t_5$ denotes the run starting time.

When the cage No. 1A responds to the second floor hall call, in the normal operation time as shown in FIG. 16(a), the cage door starts opening from the time $t_1$ when the cage arrives at a point 75 mm before the second floor, and the door is completely opened, for example, at the time $t_2$ after 2 seconds (e.g., 0.5 sec. from the stopping time $t_0$). The door opening time is set for 2 seconds from here. When it becomes the time $t_3$, the door starts closing, and the door is completely closed, for example, at the time $t_4$ after 2 seconds. Thereafter, after 1 second of delay time is elapsed, the cage starts running at the time $t_5$. As a result, the time Y during the stopping becomes $0.5+2+2+1=5.5$ seconds.

Then, when the cage No. 1A is stopped at the delaying operation time as shown in FIG. 16(b), the door starts opening lately as compared with the normal time, i.e., at the cage stopping time $t_0$, and is opened at a speed slower than the normal speed, and completely opened for 2.5 sec. 4 seconds of door opening time extended from the normal time from the time $t_2$ is set, and the door starts closing from the time $t_3$. The door is closed at a speed slower than the normal speed, and when the door is completely closed at the time $t_4$, for example, after 2.5 sec., the cage starts running at the time $t_5$ after the late time of 1.5 sec. longer than the normal time is elapsed. As a result, the stopping time Y becomes $2.5+4+2.5+1.5=10.5$ sec. Thus, the stopping time of the cage is extended by 5 sec. as compared with the normal stopping time per one stop.

In this manner, the cage to be additionally assigned to be arrived earlier than the reference time is delayed in the door opening and closing time as compared with the normal door opening and closing time, the door opening and closing speeds are delayed as compared with the normal speeds, the noninterfering time is set longer than the normal time, and the time required for the door opening and closing time is increased as compared with the normal time. Accordingly, the cage can be arrived at the first floor as the reference time.

According to the second to fifth embodiments of the present invention as described above, there is provided the group supervisory apparatus for the elevator for selecting and assigning the cages to be serviced from the plurality of cages for the hall call to respond to the hall call comprising the reference time setting means for setting the reference time that the assigned cage becomes the predetermined state in the specific hall, the predicting time for predicting the time that the cage becomes the predetermined state in the specific hall, the assigning means for selecting and assigning the cage to be assigned on the basis of the deviation between the predicting time and the reference time, the discriminating means for comparing the predicting time of the cage to be assigned with the reference time to output the arrival delay time for the cage to be assigned when the fact that the predicting time is earlier than the reference time is detected, and the delaying means for switching to the delaying operation for increasing the stopping or running time of the cage to be assigned on the way of the floor to the specific hall in response to the arrival delay command. Therefore, the cage to be assigned can be arrived at the floor of congestion and the specific floor as the reference time to improve the transportation efficiency of the floor of congestion, thereby shortening the waiting time of the hall call.

In the first, second to fifth embodiments described above, the total sum of the predicted waiting time of the hall call to be assigned is used as the assignment evaluation value in the assignment program 34 for selecting the first cage to be assigned (premonition cage). However, the method of calculating the assignment evaluation value is not limited to this. For example, it is apparent to be applied with the present invention even if the total sum of the square of the predicted waiting time of a plurality of hall calls registered is used as the assignment evaluation value or the maximum value of the predicted waiting time is similarly used as t the assignment evaluation value.

The delaying operation for increasing the stopping or running time of the cage is not limited to that of the second to fifth embodiments. For example, in an elevator for starting the door closure after a predetermined time (e.g., 1 sec.) from when a light beam is shielded by installing a photoelectric device near the exit of the cage, when an arrival delay command is generated, it can be easily executed to increase the cage stopping time by extending the predetermined time by 2 sec. As $t(i)-ta(w(i))\geqq Tx$, the arrival delay command is validated only when the difference of predetermined value Tx or more occurs, the degree of delaying the cage is varied in response to the magnitude of the difference between the arrival predicting time and the reference time, or the delaying operation for combining a plurality of delaying operations can be used.

FIGS. 17 to 22(*a*) and 22(*b*) are views showing a sixth embodiment of a group supervisory apparatus according to the present invention.

Figure 17:
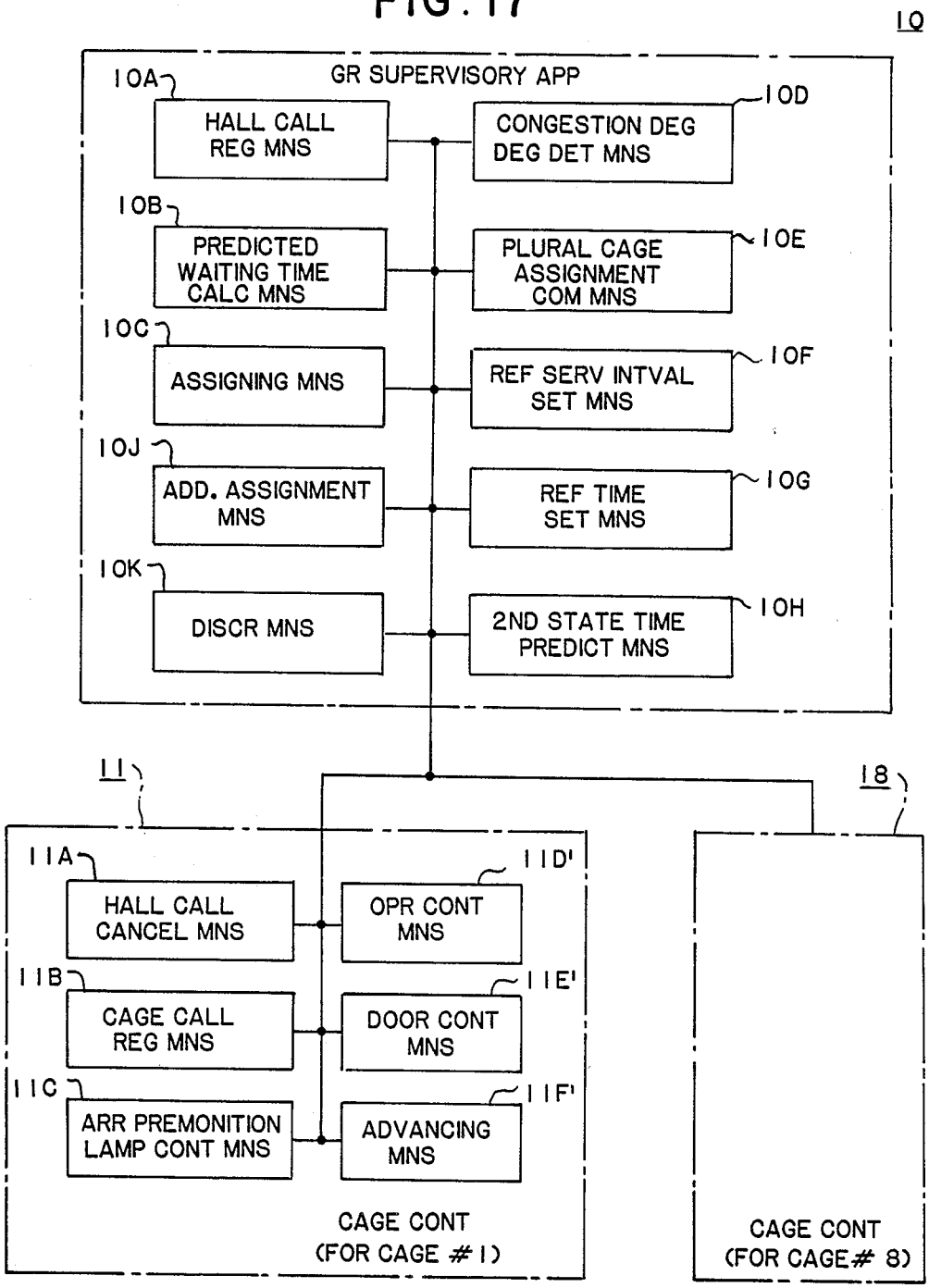
FIG. 17 is a view of an entire arrangement of a sixth embodiment of a group supervisory apparatus for an elevator according to the present invention.

FIG. 17 is a view of an entire arrangement of a group supervisory apparatus of the sixth embodiment, wherein the same symbols as those in FIG. 1 indicate the same or equivalent components. The arrangement of the group supervisory apparatus 10 is the same as that in FIG. 3.

In the drawings, symbol 10K denotes discriminating means for discriminating whether a advancing operation is commanded to the cage to be additionally assigned to output an arrival advancing command signal. The times are always set at present time point as a starting point to be the time in the group supervision.

Symbol 11D' denotes operation control means for controlling the basic operations, such as running, stopping or serving direction of the cage so as to respond to the cage call or the assigned hall call, symbol 11E' denotes door control means for controlling the opening/closing of an elevator cage door, and symbol 11F' denotes advancing means for outputting a command signal for increasing the maximum speed and the acceleration/deceleration when receiving the arrival advancing command signal.

Figure 18:
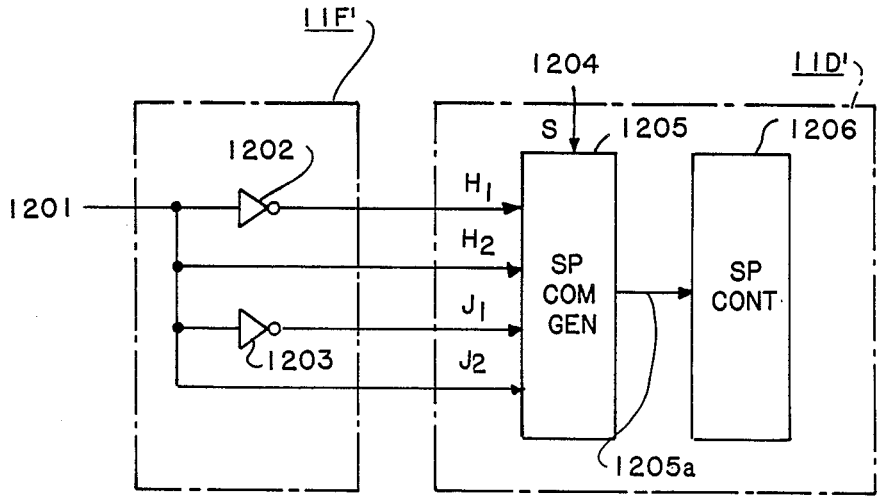
FIG. 18 is a logic circuit diagram of operation control means and advancing means.
Figure 19:
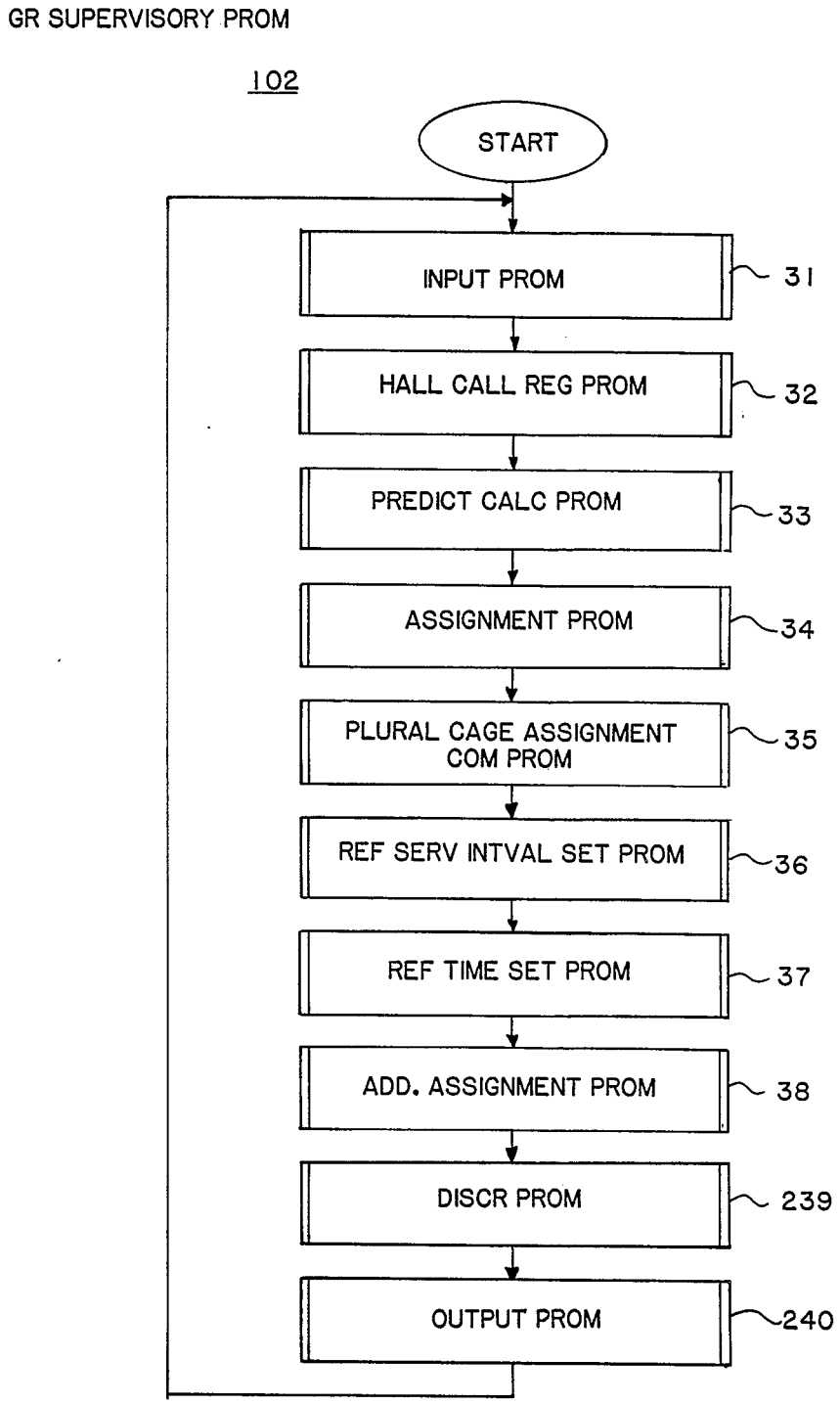
FIG. 19 is a flow chart of a group supervisory program.
Figure 20:
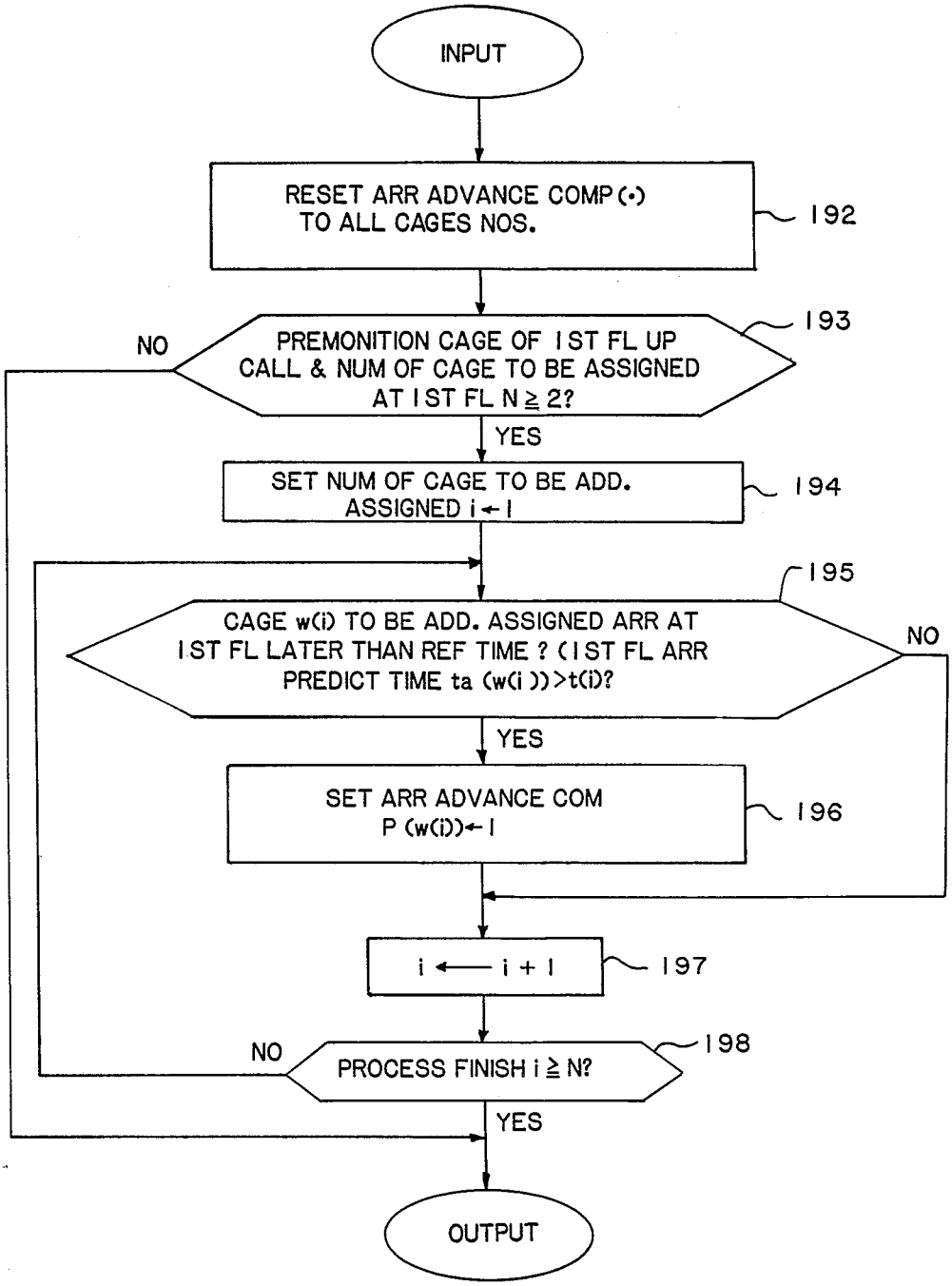
FIG. 20 is a flow chart of a discriminating program.

Then, the operation of the sixth embodiment will be described with reference to FIGS. 18 to 20. FIG. 18 is a block diagram of advancing means 11F' and operation control means 11D' of the sixth embodiment of the group supervisory apparatus according to the present invention. In FIG. 18, numeral 1201 denotes an arrival advancing command signal which becomes "L" when inputted from the group supervisory apparatus 10 to be operated at the ordinary speed and "H" when increased at the maximum speed and the acceleration/deceleration to be advanced, numerals 1202 and 1203 denote NOT gates, numeral 1204 denotes a run command signal which becomes "H" when the cage is started to run and "L" when the cage is stopped, numeral 1205 denotes a speed command generator for generating a speed command signal 1205*a* of the maximum speed and the acceleration/deceleration corresponding to terminals $H_1$, $H_2$ and $J_1$, $J_2$ when the run command signal 1204 inputted to a terminal S becomes from "L" to "H". The terminals $H_1$, $H_2$ correspond to 150 m/min. and 90 m/min. of the maximum speed, and the terminals $J_1$, $J_2$ correspond to 0.9 m/sec$^2$ and 0.8 m/sec$^2$ of the acceleration/deceleration. Numeral 1206 denotes a speed controller for controlling the speed of the cage according to the speed command signal 1205*a*. FIG. 19 is a flow chart showing a group supervisory program stored in ROM 102 of MCOM of the group supervisory apparatus 10, and FIG. 20 is a flow chart similarly showing the discriminating program.

The general operation of the group supervision will be first described with reference to FIG. 19. Steps 31 to 38 are similar to those in the first embodiment in FIG. 4, and the description thereof will be omitted.

The discriminating program of a step 239 discriminates whether an advancing operation is commanded to each cage to be additionally assigned or not to output an arrival advancing command signal.

The output program of a step 240 outputs a hall button lamp signal 20, an assignment signal, a premonition signal, etc. as known.

The group supervisory programs 31 to 39, 239, 240 are executed once per one second in this sequence.

Then, the operation of the discriminating program 239 will be described with reference to FIG. 20.

A step 192 resets the arrival advancing commands p(i) (i=1, 2, . . . , 8) for all cages Nos. to "0". A step 193 discriminates whether there is the cage premonished for the 1st up call or not and whether the number N of the cages to be assigned at the first floor is two or more or not. If the assignment of a plurality of cages is commanded for the first floor, a step 194 initializes the variable i representing the number of the cages to be additionally assigned to "1".

Steps 195 to 198 discriminate whether an advancing operation is necessary for (N−1) of the cages w(i) (i=1, 2, . . . , N−1) to be additionally assigned or not. The step 195 discriminates whether the i-th cage w(i) to be additionally assigned is predicted to arrive at the first floor later than the reference time t(i) or not. If the arrival predicting time ta (w(i)) of the cage w(i) to be additionally assigned is larger than the reference time t(i), the step 196 sets the arrival advancing command p (w(i)) to "1". The step 197 increases the number i of the cages to be additionally assigned by "1" so as to discriminate the advancing operation of the number i of the next (i+1)-th cage to be additionally assigned, and if the step 198 discriminates that the number i of the cages to be additionally assigned does not arrive at the number N of the cages to be assigned, the program again returns to the step 195 to discriminate whether the advancing operation for the next cages to be additionally assigned is needed or not. This operation is repeated until the number i of the cages to be additionally assigned arrives at the number N of the cages to be assigned.

Finally, the forcible stop of the cage according to the ordinary cage call registration and the arrival advancing command signal will be described with reference to FIG. 18.

Since the arrival advancing command signal 1201 is ordinarily "L", the outputs of the NOT gates 1202 and 1203 are all "H", and the inputs of the terminals $H_1$, $J_1$ of the speed command generator 1205 becomes "H". Thus, the speed command generator 1205 outputs the speed command signal 205*a* corresponding to the input, and the cage is operated by the speed controller 1206 at 150 m/min of the maximum speed and 0.9 m/sec$^2$ of the acceleration/deceleration.

When the cage No. 1 of the cage to be additionally assigned for the 1st up call is predicted to arrive later than the reference time, the arrival advancing command signal 1201 becomes "H". Accordingly, the inputs of the terminals $H_2$, $J_2$ of the speed command generator 1205 become "H". Thus, the cage No. 1 is operated at 90 m/min of the maximum speed and 0.8 m/sec$^2$ of the acceleration/deceleration to increase its running time. Therefore, since the arrival of the cage at the first floor is advanced, the cage can be arrived at the first floor as the reference time.

In the sixth embodiment as described above, when the congestion of the first floor hall is detected, the reference service interval is set in response to the traffic volume at the first floor and the traffic volume at the floors except the first floor, the reference time for the arrival time to the first floor is set in response to the number of the cages to be additionally assigned on the basis of the reference service interval and the first state time of the predetermined cage (the lapse time from the arrival of the cage finally arrived at the first floor, or the arrival predicting time of the premonition cage of the 1st up call), and the cage having the small deviation between the arrival predicting time at the first floor and the reference time is selected as the cage to be additionally assigned. When the fact that the arrival predicting time of the cage to be additionally assigned is later than the reference time is detected, the arrival advancing command is produced to increase the maximum speed and the acceleration/deceleration of the cage to be additionally assigned, thereby shortening the running time of the cage on the way to the floor. Accordingly, the cages are not concentratively arrived at the first floor to be serviced, and the transportation efficiency when the first floor is congested can be improved to shorten the waiting time at the other floors.

Figure 21:
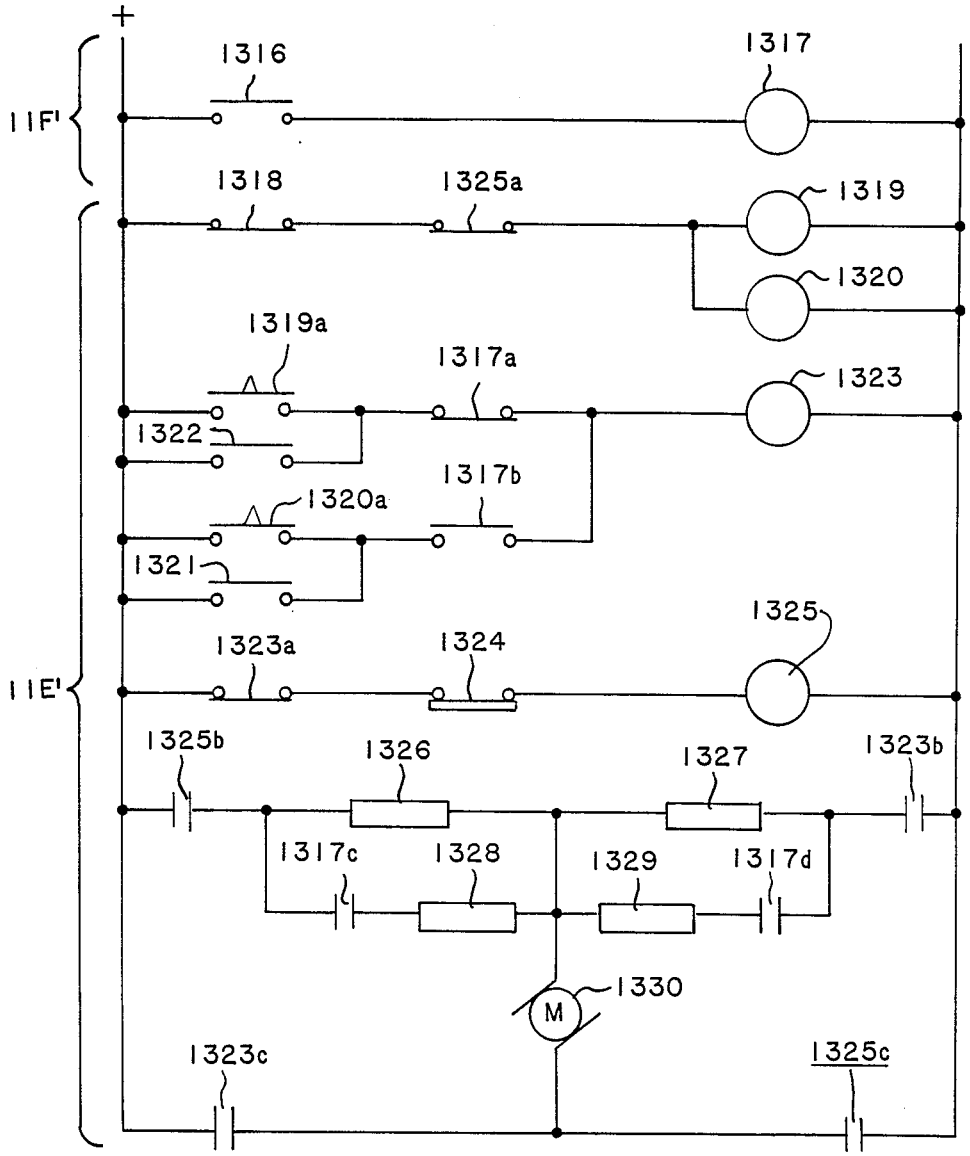
Figure 22A:
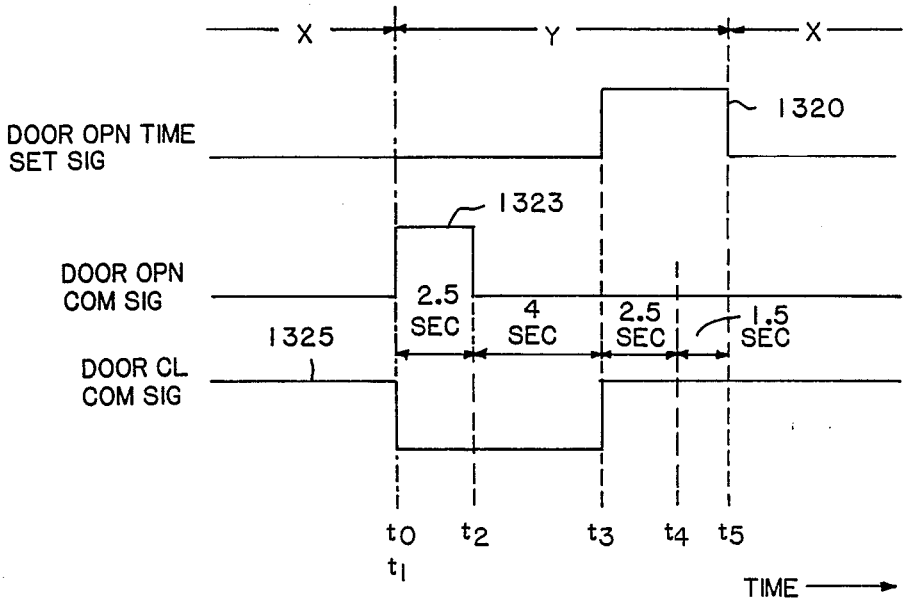
Figure 22B:
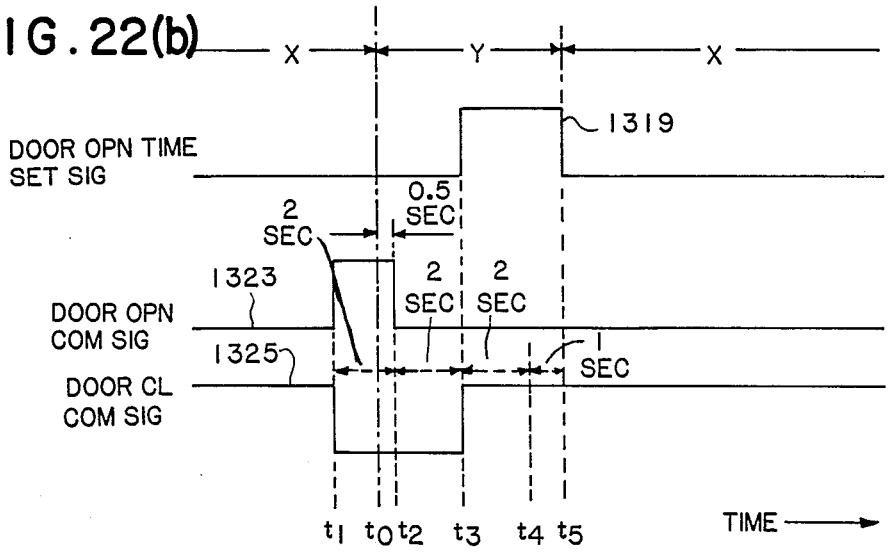

FIGS. 21 and 22(*a*) and 22(*b*) show a seventh embodiment of a group supervisory apparatus according to the present invention. FIG. 21 shows a relay circuit diagram of advancing means 11F' and door control means 11E' to increase the time required for opening or closing a cage door to be advanced as compared with the usual time.

In the drawings, symbols (+) and (−) denote DC power source, numeral 1316 denotes an arrival advancing command relay contact closed when the arrival advancing command signal is outputted from the group supervisory apparatus 10, numeral 1317 denotes an advancing operation switching relay, symbols 1317*a* denotes its normally closed contact, symbols 1317*b* to 1317*d* denote normally open contacts, numeral 1318 denotes a run relay contact opened while the cage is being run, numeral 1319 denotes a door opening time setting time limiting relay which is operated after a predetermined time (e.g., 4 sec.) when energized and immediately reset when deenergized, symbol 1319*a* denotes its normally open contact, numeral 1320 denotes a door opening time setting time limiting relay set similarly to 2 sec., symbol 1320*a* denotes its normally open contact, numeral 1321 denotes a prelanding detection relay contact closed while a cage floor arrives at a point of a predetermined distance (e.g., approx. 75 mm) from the floor to be stopped at after the cage is started, numeral 1322 denotes a floor stopping detection relay contact closed while the cage is similarly stopped at the floor to be stopped at, numeral 1323 denotes a door closing relay, symbols 1323*a* denotes its normally closed contact, symbols 1323*b* and 1323*c* denote normally open contacts, numeral 1324 denotes a fully-open detection switch opened when the cage door is fully opened, numeral 325 denotes a door opening relay, symbol 1325*a* denotes its normally closed contact, symbols 1325*b* and 1325*c* denote similarly normally open contacts, numerals 1326 to 1329 denote resistors, and numeral 1330 denotes an armature of a motor for driving the cage door (a field of the motor is omitted).

Then, the operation of the seventh embodiment will be described.

Since the arrival advancing command relay contact 1316 is ordinarily opened, the advancing operation switching relay 1317 is deenergized, the contact 1317*a* is closed, and the contacts 1317*b* to 317*d* are opened.

Assume now that, while the cage No. 1 is being run down at the fifth floor, it responds to the cage call at the fourth floor. At this time, since the prelanding detection relay contact 1322 is closed, the door closing relay 1323 is energized in the circuit of (+) DC power source, the contact 1322, the contact 1317*a*, the relay 1323 and (−) DC power source, the contact 1323*a* is opened, and the contacts 1323*b* and 1323*c* are closed. The door opening relay 1325 is deenergized by the opening of the contact 1323*a*, and the contact 1325*a* is closed. Since the run relay contact 1318 is opened, the relays 1319 and 1320 for limiting the door opening time setting time are together deenergized. A current flows to the armature 1330 by the circuit of the (+) DC power source, the contact 1323*c*, the armature of the motor, through the resistor 1327, the contact 1323*b* and the (−) DC power source by the closure of the contacts 1323*b* and 1323*c*. The door is pressed at the closed position in a door closing direction.

When the cage No. 1 approaches the fourth floor, it starts decelerating, and immediately before the cage No. 1 arrives at the fourth floor, the floor stopping detection relay contact 1322 is deenergized. Thus, the door closing relay 1323 is deenergized, the contact 1323*a* is closed, and the contacts 1323*b* and 1323*c* are opened. The door opening relay 1325 is energized by the closure of the contact 1323*a*, the contact 1325*a* is opened, and the contacts 1325*b* and 1325*c* are closed. Thus, since a current flows to the armature 1330 reversely to the previous current in the circuit of the (+) DC power source, the contact 1325*b*, through the resistor 1326 or the contact 1317*c* and the resistor 328, the armature 1330, the contact 1325*c* and the (−) DC power source, the door starts opening. The run relay contact 1318 is closed by the stop of the cage No. 1, but since the contact 1325*a* is already opened, the door opening time setting time limiting relays 1319 and 1320 are not energized. When the door of the cage No. 1 is completely opened, the fully-open detection switch 1324 is opened. Thus, the door opening relay 1325 is deenergized, the contact 1325*a* is closed, and the contacts 1325*b* and 1325*c* are opened. The door opening time setting time limiting relays 1319 and 1320 are energized by the closure of the contact 1325*a*, the time limiting relay 1319 is operated after 2 seconds, and since the contact 1320*a* is closed but the contact 1317*b* is opened, no variation occurs in the circuit. When 4 seconds are elapsed from the closure of the contact 1325*a*, the time limiting relay 1319 is operated to close the contact 1329*a*. Thus, the door closing relay 1323 is energized in the circuit of the (+) DC power source, the contact 1319*a*, the contact 1317*a*, the relay 1323 and the (−) DC power source. Thus, a current the contacts 1323*b* and 1322*c* are closed, and the door starts closing. When the door is completely closed, after a slight delay time is elapsed, the cage No. 1 is started to again start running downward. When the cage No. 1 starts running down, the run relay contact 1318 is simultaneously opened, the door opening time setting time limiting relays 1319 and 1320 are deenergized, and the contacts 1319*a* and 1320*a* are opened. However, since the floor stopping detection relay contact 1322 is closed at this time, the door closing relay 1323 is held. The above-described operation is for delaying the operation of the cage.

Then, when the arrival advancing command signal is outputted, the arrival advancing command relay 1316 is closed, the advancing operation switching relay 1317 is energized to open the contact 1317*a* and close the contacts 1317*b* to 1317*d*.

In the same manner as described above, assume that the cage No. 1 is now being run down at fifth floor and responds to the cage call at the fourth floor. Since the floor stopping detection relay contact 1321 is closed at this time, the door closing relay 1323 is energized in the circuit of the (+) DC power source, the contact 1321, the contact 1317*d*, the relay 1323 and the (−) DC power source.

When the cage No. 1 approaches the fourth floor to be decelerated and stopped at the cage floor at a point 75 mm before the fourth floor, the prelanding detection relay contact 1321 is opened. Accordingly, the door closing relay 1323 is deenergized. When the contact 1323*a* is closed, the door closing relay 1325 is energized similarly to the above to close the contacts 1325*b* and 1325*c*. Since the advancing operation switching relay contacts 1317*b* and 1317*c* are now closed, a current flows reversely to the above to the armature 1330 in the circuit of the (+) DC power source, the contact 1325*b*, through the resistor 1326 or the contact 1317*c* and the resistor 1328, the armature 1330, the contact 1325*c* and the (−) DC power source, and the door starts opening. Since the current becomes smaller than the normal current, the rotating speed of the armature 1330, i.e., the door opening speed becomes faster than the usual speed, and the door opening operation takes shorter than the normal speed. When the door is fully opened and the contact 1325*a* is closed, the door opening time setting time limiting relays 1319 and 1320*a* are energized, the time limiting relay 1319 is operated after 2 seconds, the contact 1320*a* is closed. Thus, the door closing relay 323 is energized earlier than the normal by the circuit of the (+) DC power source, the contact 1320*a*, the contact 1317*b*, the relay 1323 and the (−) DC power source. In this manner, a current larger than the normal current flows to the armature 1330 in the circuit of the (+) DC power source, the contact 1323*c*, the contact 1323*c*, through the resistor 1327 or the resistor 1329 and the contact 1317*d*, the contact 1323*b* and the (−) DC power source. Therefore, the door closing speed is faster than the normal speed, and the door closing operation takes shorter than the normal time.

FIGS. 22(*a*) and 22(*b*) show door opening and closing time waveforms for explaining the concrete door opening and closing operations when controlled as described above, FIG. 11(*a*) shows that at the normal operation time, and FIG. 11(*b*) shows that at the advancing operation time. In FIGS. 22, symbol X denotes the running time of the cage, symbol Y denotes the stopping time of the cage, symbol $t_0$ denotes the time when the cage stops at the hall floor, symbol $t_1$ denotes the door opening or closing starting time, symbol $t_2$ denotes the door fully opening time, symbol $t_3$ denotes the door closing starting time, symbol $t_4$ denotes the door fully closing time, and symbol $t_5$ denotes the run starting time.

When the cage No. 1A responds to the second floor hall call, in the normal operation time as shown in FIG. 22(*a*), the cage door starts opening from the time $t_0$ (coincides with the time $t_1$) when the cage is stopped at the hall floor, and the door is completely opened, for example, at the time $t_2$ after 2.5 seconds. The door opening time is set for 4 seconds from here. When it becomes the time $t_3$, the door starts closing, and the door is completely closed, for example, at the time $t_4$ after 2.5 seconds. From here the door opening time is set for 4 seconds, and when it becomes the time $t_3$, the door starts closing, and the door is, for example, fully closed after 1.5 second of delay time. Thereafter, after 1.5 second of delay time is elapsed, the cage starts running at the time $t_5$. As a result, the time Y during the stopping becomes $2.5+4+2.5+1.5=10.5$ seconds.

Then, when the cage No. 1A is stopped at the advancing operation time as shown in FIG. 22(*b*), the door starts opening earlier as compared with the normal time, i.e., at a position 75 mm before the floor at the time $t_0$, and is opened at a speed faster than the normal speed, and completely opened for 2 sec. (after 0.5 sec., for example, from the stopping time $t_0$) 2 seconds of door opening time shortened from the normal time from the time $t_2$ is set, and the door starts closing from the time $t_3$. The door is closed at a speed faster than the normal speed, and when the door is completely closed at the time $t_4$, for example, after 2 sec., the cage starts running at the time $t_5$ after the late time of 1 sec. shorter than the normal time is elapsed. As a result, the stopping time Y becomes $0.5+2+2+1=5.5$ sec. Thus, the stopping time of the cage is shortened by 5 sec. as compared with the normal stopping time per one stop.

In this manner, the cage to be additionally assigned to be arrived later than the reference time is advanced in the door opening and closing time as compared with the normal door opening and closing time, the door opening and closing speeds are advanced as compared with the normal speeds, the noninterfering time is set shorter than the normal time, and the time required for the door opening and closing time is decreased as compared with the normal time. Accordingly, the cage can be arrived at the first floor as the reference time.

In the sixth and the seventh embodiments described above, the total sum of the square of the predicted waiting time of the hall call to be assigned is used as the assignment evaluation value in the assignment program 34 for selecting the first cage to be assigned (premonition cage). However, the method of calculating the assignment evaluation value is not limited to this. For example, it is apparent to be applied with the present invention even if the total sum of the predicted waiting time of a plurality of hall calls registered is used as the assignment evaluation value or the maximum value of the predicted waiting time is similarly used as t the assignment evaluation value.

In the sixth and the seventh embodiments described above, the advancing operation for decreasing the stopping or running time of the cage is not limited to that of the sixth and seventh embodiments. For example, in an elevator for starting the door closure after a predetermined time (e.g., 2 sec.) from when a light beam is shielded by installing a photoelectric device near the exit of the cage, when an arrival advancing command is generated, it can be easily executed to decrease the cage stopping time by shortening the predetermined time by 1 sec. When the arrival advancing command is received, it is easy to reduce the stopping time of the cage by limiting the assignment of the cage to new hall call on the way of the floor to the specific hall. For example, as disclosed in Japanese Patent Laid-open application No. 87446/1978, it is considered to utilize a method of scarcely assigning the hall call on the way to the floor by adding the hall priority to the predicted waiting time to set the apparent predicted waiting time to a longer value. In this case, the assignment evaluation value may be calculated by adding the hall priority to the predicted waiting time of the hall call at the specific floor for the cage to be additionally assigned upon reception of the arrival advancing command. Further, As $ta(w(i))-t(i)\geqq Tx$, the arrival advancing command is validated only when the difference of predetermined value Tx or more occurs, the degree of advancing the cage is varied in response to the magnitude of the difference between the arrival predicting time and the reference time, or the advancing operation for combining a plurality of advancing operations can be used.

According to the sixth and seventh embodiments of the present invention as described above, there is provided the group supervisory apparatus for the elevator for selecting and assigning the cages to be serviced from the plurality of cages for the hall call to respond to the hall call comprising the reference time setting means for setting the reference time that the assigned cage becomes the predetermined state in the specific hall, the predicting time for predicting the time that the cage becomes the predetermined state in the specific hall, the assigning means for selecting and assigning the cage to be assigned on the basis of the deviation between the predicting time and the reference time, the discriminating means for comparing the predicting time of the cage to be assigned with the reference time to output the arrival advancing time for the cage to be assigned when the fact that the predicting time is later than the reference time is detected, and the advancing means for switching to the advancing operation for decreasing the stopping or running time of the cage to be assigned on the way of the floor to the specific hall in response to the arrival advancing command. Therefore, the cage to be assigned can be arrived at the floor of congestion and the specific floor as the reference time to improve the transportation efficiency of the floor of congestion, thereby shortening the waiting time of the hall call.

In the first to seventh embodiments described above, the congestion of the first floor is discriminated by the time and the number of waiting passengers by the waiting passenger number detector to command the assignment of the plurality of cages. However, the number of the passengers boarding the cage from the first floor may be detected by using a cage floor weighing device. Further, the floor of congestion is decided as the first floor at the office-going time zone. However, the invention is not limited to this. The invention can be easily applied to the floor of congestion, such as the dining room floor or main floor of the lunch time zone, the meeting room floor at the meeting end time.

In the first to seventh embodiments described above, the number of passengers in the cages in the respective floors detected by using cage floor weighing devices are integrated to obtain the traffic volume Ra for 5 min. in the past at the first floor, and the time required to generating the passengers of the number corresponding to a predetermined value P ($=P_0$) is set as the reference service interval $T_0$ on the basis of the traffic volume Ra and the cage passenger capacity $P_0$ ($=20$ persons). Further, the numbers of the passengers in the cage except the first floor are integrated to obtain the traffic volume Rb for 5 min. in the past at the floors except the first floor, and the reference service interval $T_0$ set in response to the traffic volume Ra at the first floor is increased or decreased to be corrected by considering the magnitude of the traffic volume Rb. However, the method of determining the reference service interval $T_0$ responsive to the traffic volume is not limited only to this. It is easy to alter the predetermined value P according to the seasons by reducing the value P by approx. 80% of the passenger capacity of the cage in winter or to set it at every building according to the utility of the building. Further, the reference service interval $T_0$ may be corrected to $T_0 \leftarrow (T_0 - Tx2)$ in case of the ratio $Ra/Rb > 2.0$ in response to the magnitude of the ratio Ra/Rb of the traffic volumes of the floor of congestion to the floor except the floor of congestion, e.g., the first floor to the other floor except the first floor and to $T_0 \leftarrow (T_0 + Tx1)$ in case of the ratio $Ra/Rb < 0.5$. Moreover, the traffic volumes Ra, Rb may not only be set according to the measured value at that date, but may be set by statistically processing the measured values every day and using the result. In the embodiments described above, the traffic volumes Ra, Rb are represented by the number of the passengers in the cage for 5 min. However, the traffic volume is not limited only to this, and may be represented by other factors. For example, the traffic volume may be replaced by the number of occurrences of the hall calls per unit time. Further, as disclosed in Japanese Patent Laid-open application No. 121186/1987, even if the reference service interval $T_0$ is set on the basis of one cycle time, the present invention may be applied within the scope of the invention.

In the embodiments described above, the first and second states are defined so that the cage arrives at the first floor in view of the arrival time point at the first floor, and the reference service interval corresponding thereto is used. However, as described with reference to FIG. 2, the method of deciding the service interval is not limited only to this. For example, the first and second states may be defined to become departing states of the cage from the first floor in view of the departing time point of the cages. At this time, the lapse time from the departure of the cage departed from the first floor is calculated as the lapse time tc at the last of the steps 70 to 72 of the reference time setting program in FIG. 7, the arrival predicting time twa of the first floor of the premonition cage may be replaced by the departure predicting time tws (which uses the departure predicting time calculated in the predicting calculating program 33), and the arrival predicting time ta(j) may be replaced with the departure predicting time ts(j) (which also uses the departure predicting time calculated in the predicting calculating program 33) in the steps 86 and 87 of the additional assignment program 38 for use. In addition, the service interval in view of the time points, such as to be defined such that the first state is the departing state and the second state is the arrival state can be considered. Any service interval in view of any time point may provide similar advantages as those of the embodiments described above according to the invention.

In the embodiments described above, the reference service interval is sequentially added to the lapse time of the cage arrived at the last after arrival and the arrival predicting time of the premonition cage to set the reference time corresponding to the number of the cages to be additionally assigned. However, the method of setting the reference time is not limited only to this. For example, the reference time t(i) (i=1, 2, 3) when the first state is defined to be the departing state and the second state is defined to be the arrival state may be set as below.

t(1)←(departure predicting time of premonition cage)+$T_0$ t(2)←(departure predicting time of 1st cage to be additionally assigned)+$T_0$ t(3)←(departure predicting time of 2nd cage to be additionally assigned)+$T_0$ More specifically, any method may be employed if the reference time for selecting the cage to be additionally assigned may be so set that the period from the time point when the cage to be previously serviced becomes the first state to the time point when the cage to be lately serviced becomes the second state becomes equal interval.

Further, in the embodiments described above, in view of only the deviation between the reference time and the second state predicting time (arrival predicting time), the cage having the minimum deviation is selected as the cage to be additionally assigned. However, the method of selecting the cage having the small deviation to be additionally assigned is not limited only to this. For example, the assignment evaluation value, such as the total evaluation value is obtained by adding the deviation by weighing to the total sum of the predicted waiting time to attain the total evaluation value, and other evaluation value is combined by selecting the cage having the minimum total evaluation value to select the cage to be additionally assigned. It is the preferential assignment of the cage having the small deviation to evaluate and assign the cage in combination with the other evaluation value, and it is apparent to select the cage having small deviation.

What is claimed is:

1. A group supervisory apparatus for an elevator for selecting and assigning a cage to be serviced from a plurality of cages to respond to a hall call comprising:

plural cage assignment command means for commanding the assignment of a plurality of cages for said hall call of the hall when the congestion of the hall is detected;

reference service interval setting means for setting a reference value of a period from when the cage to be previously serviced in the hall of congestion becomes a first state of one of operating states of the cage generated upon operation of the cage to when the cage to be similarly serviced later becomes a second state of one of the above-described states of the cage in response to the traffic volume of the hall of congestion, reference time setting means for setting a reference value of a time when the other cage becomes said second state in said hall of congestion in response to the number of cages to be additionally assigned on the basis of the first state time when the cage becomes the first state and the reference service interval, second state time predicting means for predicting a time when the cage becomes the second state in the hall of congestion, and additional assignment means for selecting and assigning the cage having a small deviation between the second state predicting time of the hall of congestion and the reference time of the cage to be additionally assigned upon reception of the command from said plural cages assignment command means.

2. A group supervisory apparatus for an elevator according to claim 1, wherein said reference time setting means comprises first state time predicting means for predicting a time becoming the first state in the hall of congestion to add said reference service interval to the first state predicting time of the cage predicted to be assigned to be first serviced to set the reference time corresponding to the number of cages to be additionally assigned.

3. A group supervisory apparatus for an elevator according to claim 1, wherein said reference time setting means comprises lapse time calculating means for calculating a time elapsed from when the cage becomes the first state in the hall of congestion to add the reference service interval to the lapse time of the cage serviced at the last as negative value to set the reference time corresponding to the number of the cages to be additionally assigned.

4. A group supervisory apparatus for an elevator according to any of claims 1 to 3, wherein the departing states of the cages in the hall of congestion are defined as first and second states, and said reference service interval setting means sets the time required until the number of passengers generated in the hall of congestion becomes a predetermined value or larger as a reference service interval.

5. A group supervisory apparatus for an elevator according to any of claims 1 to 3, wherein the arrival states of the cages n the hall of congestion are defined as first and second states, and said reference service interval setting means sets the time required until the number of passengers generated in the hall of congestion becomes a predetermined value or larger as a reference service interval.

6. A group supervisory apparatus for an elevator according to any of claims 1 to 3, wherein said reference service interval setting means sets the reference service interval in response to the traffic volume of the hall of congestion and the traffic volume of the hall except the hall of congestion to correct the reference service interval so as to be shorter than the reference service interval set in response to the traffic volume of the hall of congestion when the traffic volume of the hall except the hall of congestion is less than the predetermined value.

7. A group supervisory apparatus for an elevator according to any of claims 1 to 3, wherein said reference service interval setting means sets the reference service interval in response to the traffic volume of the hall of congestion and the traffic volume of the hall except the hall of congestion to correct the reference service interval so as to be longer than the reference service interval set in response to the traffic volume of the hall of congestion when the traffic volume of the hall except the hall of congestion is more than the predetermined value.

8. A group supervisory apparatus for an elevator according to claim 1, wherein said additional assignment means temporarily cancels the assignment of the cage not premonished for the hall of congestion of the cages to be assigned in the hall of congestion and reselects new cage to be assigned.

9. A group supervisory apparatus for an elevator according to claim 1, wherein said additional assignment means selects from the cages to be predicted to arrive later than the cage premonished for the hall of congestion.

10. A group supervisory apparatus for an elevator for selecting and assigning a cage to be serviced from a plurality of cages to respond to the hall call comprises:

reference time setting means for setting a reference time when the assigned cage becomes a predetermined state in a specific hall, predicting means for predicting a time when the cage becomes the predetermined state in the specific hall, assigning means for selecting and assigning the cage to be assigned on the basis of the deviation between the predicting time and the reference time according to the predicting means, discriminating means for comparing the predicting time of the assigned cage and the reference time to output an arrival delay command to the cage to be assigned by detecting the fact that the predicting time is earlier than the reference time, and delaying means for switching to a delaying operation to increase the stopping time or running time of the assigned cage in the midway floor to the destination of the specific floor in response to the arrival delay command.

11. A group supervisory apparatus for an elevator according to claim 10, wherein said delaying means stops the departure of the cage upon reception of the arrival delay command for a predetermined time to switch to the operation of stopping the departure for increasing the stopping time of the cage.

12. A group supervisory apparatus for an elevator according to claim 10, wherein said delaying means decreases the maximum speed of the acceleration/deceleration of the cage on the way to the floor to the specific hall as compared with the ordinary speed upon reception of the arrival delay command to switch to the extending operation of the running time for increasing the running time of the cage.

13. A group supervisory apparatus for an elevator according to claim 10, wherein said delaying means forcibly stops the cage at the floor having neither cage call nor hall call of the floor on the way to the specific hall upon reception of the arrival delay command to switch to the forcibly stopping operation for increasing the stopping time of the cage.

14. A group supervisory apparatus for an elevator according to claim 10, wherein said delaying means switches the time required for the cage door opening and closing operation of the cage on the way to the floor to the specific hall upon reception of the arrival delay command to the extension of the door opening and closing operation for increasing the time required as compared with the ordinary time.

15. A group supervisory apparatus for an elevator for selecting and assigning a cage to be serviced from a plurality of cages to respond to a hall call comprising:

reference time setting means for setting a reference time when the assigned cage becomes a predetermined state in a specific hall, predicting means for predicting a time when the cage becomes the predetermined state in the specific hall, assigning means for selecting and assigning the cage to be assigned on the basis of the deviation between the predicting time and the reference time according to the predicting means, discriminating means for comparing the predicting time of the assigned cage and the reference time to output an arrival delay command to the cage to be assigned by detecting the fact that the predicting time is later than the reference time, and advancing means for switching to an advancing operation to decrease the stopping time or running time of the assigned cage in the midway floor to the destination of the specific floor in response to the arrival delay command.

* * * * *